United States Patent [19]

Sakura

[11] Patent Number: 4,639,287

[45] Date of Patent: Jan. 27, 1987

[54] LABEL FEED CONTROL SYSTEM

[75] Inventor: Yasuhiro Sakura, Shizuoka, Japan

[73] Assignee: Tokyo Electric Co., Ltd., Tokyo, Japan

[21] Appl. No.: 265,833

[22] Filed: May 21, 1981

[30] Foreign Application Priority Data

| | | | |
|---|---|---|---|
| May 26, 1980 | [JP] | Japan | 55-69825 |
| May 26, 1980 | [JP] | Japan | 55-69826 |
| Jun. 20, 1980 | [JP] | Japan | 55-83572 |
| Jun. 20, 1980 | [JP] | Japan | 55-83573 |

[51] Int. Cl.[4] ..... B65H 5/28

[52] U.S. Cl. ..... 156/361; 156/542; 221/73

[58] Field of Search ..... 156/350, 361–363, 156/542, 584; 226/30, 42, 43, 45; 221/73

[56] References Cited

U.S. PATENT DOCUMENTS

| | | | |
|---|---|---|---|
| 3,568,881 | 3/1971 | Croney | 221/73 X |
| 4,038,127 | 7/1977 | Bullock et al. | 156/361 |
| 4,048,494 | 9/1977 | Liesting | 221/73 X |
| 4,095,732 | 6/1978 | Merritt | 226/43 X |
| 4,188,252 | 2/1980 | Brown | 156/542 |
| 4,253,902 | 3/1981 | Yada | 156/361 |
| 4,264,396 | 4/1981 | Stewart | 156/542 X |
| 4,276,112 | 6/1981 | French et al. | 156/542 X |
| 4,288,272 | 9/1981 | Pfeffer | 221/73 X |
| 4,294,644 | 10/1981 | Anderson | 156/361 |
| 4,295,915 | 10/1981 | Sakaguchi | 156/584 X |
| 4,303,461 | 12/1981 | La Mers | 156/361 |
| 4,347,950 | 9/1982 | Onishi | 221/21 X |
| 4,434,911 | 3/1984 | Sakura | 221/2 |

FOREIGN PATENT DOCUMENTS

| | | |
|---|---|---|
| 2605602 | 8/1977 | Fed. Rep. of Germany . |
| 382643 | 12/1964 | Switzerland . |

*Primary Examiner*—David Simmons

*Attorney, Agent, or Firm*—Oblon, Fisher, Spivak, McClelland & Maier

[57] ABSTRACT

In a label feed control system, a label separated from the base ribbon is fed for a predetermined amount after the front edge thereof has been detected, so that the label can be positioned accurately irrespective of the light transmissivity of the base ribbon and labels.

11 Claims, 35 Drawing Figures

Fig. 32

| | F | E | D | C | B | A | 9 | 8 | 7 | 6 | 5 | 4 | 3 | 2 | 1 | 0 |
|---|---|---|---|---|---|---|---|---|---|---|---|---|---|---|---|---|
| 0 | | | | | | | | | | | | | | | | |
| 1 | Unit price | | | Space | Weight | | | | Space | Amount | | | | Space | Code | |
| | 1 | 0 | 0 | F | 1 | 2 | 3 | 4 | F | 1 | 2 | 3 | 4 | F | 7 | 9 |
| 2 | | | | | | | | Date | | Space | Date | | Space | Date | | Space |
| | | | | | | | | 8 | 0 | F | 1 | 2 | F | 3 | 1 | F |
| 3 | | | | | | | | | | | | | Print Counter | | Print address | |
| 4 | | | | | | | | | | | | | SW "A" a | | SW "A" b | |
| | | | | | | | | | | | | | 0 | F | 1 | F |
| 5 | | | | | | | | | | | | | SW "B" a | | SW "B" b | |
| | | | | | | | | | | | | | 0 | C | 1 | F |
| 6 | | | | | | | | | | | | | SW "C" a | | SW "C" b | |
| | | | | | | | | | | | | | 1 | 5 | 2 | 8 |

Fig. 35

| | F | E | D | C | B | A | 9 | 8 | 7 | 6 | 5 | 4 | 3 | 2 | 1 | 0 |
|---|---|---|---|---|---|---|---|---|---|---|---|---|---|---|---|---|
| 0 | | | | | | | | | | | | | | | | |
| 1 | Unit Price | | | Space | Weight | | | | Space | Amount | | | | Space | Cord | |
| | 1 | 0 | 0 | F | 1 | 2 | 3 | 4 | F | 1 | 2 | 3 | 4 | F | 7 | 9 |
| 2 | | | | | | | | Date | | Space | Date | | Space | Date | | Space |
| | | | | | | | | 0 | 0 | F | 1 | 2 | F | 3 | 1 | F |
| 3 | | | | | | | | | | | | | Print Counter | | Print Address | |
| 4 | | | | | | | | | | | SW"A"c | | SW"A"a | | SW"A"b | |
| | | | | | | | | | | | 0 | F | 0 | F | 1 | F |
| 5 | | | | | | | | | | | SW"B"c | | SW"B"a | | SW"B"b | |
| | | | | | | | | | | | 0 | C | 0 | C | 1 | F |
| 6 | | | | | | | | | | | SW"C"c | | SW"C"a | | SW"C"b | |
| | | | | | | | | | | | 1 | 5 | 1 | 5 | 2 | 0 |

LABEL FEED CONTROL SYSTEM

BACKGROUND OF THE INVENTION

1. Field of the Invention

The present invention relates to a label feed control system for a label printer which issues a label after data from the weighing unit has been printed on the label sticked on the paper base ribbon.

2. Description of the Prior Art

An example of the conventional label feed control system will be described with reference to FIGS. 1 through 4. On a paper base ribbon 1 there are lightly adhered labels 2 of a certain size in a constant interval, and such ribbon 1 is wound on a label supply reel 3. The ribbon 1 is transported through a printer 4, a separator 5 on which a label is peeled off the base ribbon, and a feed roller 7 driven by a motor 6 to a ribbon take-up reel 8. On the upstream side of the printer 4 there is provided a photoelectric label position detector 9, and a label detector 10 which detects a peeled-off label 2 is provided at the front edge of the separator 5.

The weighing unit 11, the printer 4 and a keyboard 12 are connected to a CPU 13, which is further connected to an I/O port 14. The label detector 10 is connected through a label detection amplifier 15 to the I/O port 14. Also connected to the I/O port 14 is a feed controller 16, which is further connected to the motor 6 and to the position detector 9 through a position detection amplifier 18 having a variable resistor 17.

The label detector 10 produces a high D-signal when a label 2 is absent, and when an operation command, i.e. an A-signal, is issued with the signal D being high, the feed controller 16 produces a high C-signal to activate the motor 6 so that the ribbon 1 is fed. The signal C is also delivered to the CPU 13 via the I/O port 14 so as to interlock other operations during transportation. As the result of transporting the ribbon 1, a label 2 is peeled off the ribbon 1, projecting over the label detector 10 to cause its output signal D to become low. When the position detector 9 detects the label position and produces a B-signal, as will be described shortly, with the signal D being low, the signal C from the feed controller 16 turns low to stop the motor 6 and also to release the inhibited commands in the CPU 13.

The position detector 9 operates by sensing the transmissivity of the base ribbon 1 and the label 2. There are three cases in the amount of transmissivity as shown in FIG. 2-b: (a) a base ribbon 1 alone, (b) a label 2 on the base ribbon 1 and (c) a label with printed portion 20 on the base ribbon 1. The signal B is produced at the position where the base ribbon 1 alone exists. This system is based on the detection of the difference of light transmitted through the base ribbon 1 alone and the overlap of the base ribbon 1 and the label 2, and has the following problems. A label 2 having a high light transmissivity results in a very small transmission difference, requiring disadvantageously a very high accuracy of sensing. If the label 2 has a printed portion 20 as mentioned above for the shop name and the like, the lower transmissivity of this portion creates a large contrast relative to remaining portions of the label, resulting possibly in a failure of detection. Moreover, it is irksome to adjust the sensing level by the variable resistor 17 each time the thickness of the base ribbon 1 changes. In addition, the position detector 9 needs to be repositioned for each label size, and since the signal B from the position sensor 9 also serves as the operational reference for the printer 4, several labels are wasted for test printing in determination of the best setup position.

It is, therefore, the first object of the present invention to achieve the reliable positioning of the label irrespective of the right transmissivity of the label and the base ribbon.

The second object of the invention is to utilize the power frequency in positioning the label.

The third object of the invention is to control the label position digitally by use of a stepping motor.

The fourth object of the invention is to achieve the positioning of the label by numerical control.

The fifth object of the invention is to achieve the positioning of the label using the pulse signals generated by a slit disk.

The sixth object of the invention is to make common use of the detector for detecting the front edge of the label also for detecting the presence of the label, thereby controlling the print operation.

The seventh object of the invention is to achieve a sequential printing in the direction of label transportation, whereby print control and label feed control are performed reliably.

The eighth object of the invention is to achieve a sequential printing in the direction of label transportation in a simple label feed control.

BRIEF DESCRIPTION OF THE DRAWINGS

FIG. 32 is an illustration showing the RAM map of the system;

FIG. 35 is an illustration showing the RAM map of the system.

DETAILED DESCRIPTION OF THE PREFERRED EMBODIMENTS

Figure 1:
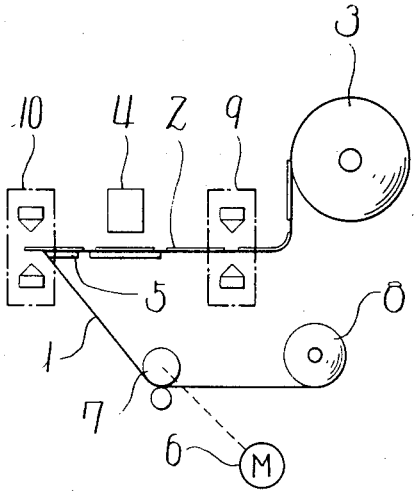
FIG. 1 is a side view of the conventional label feed control system.
Figure 2:
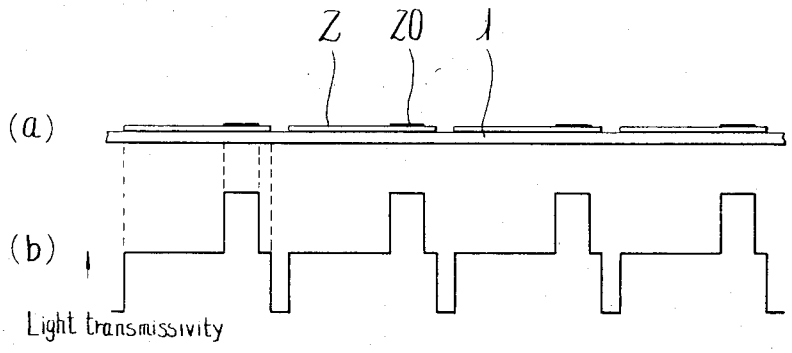
FIGS. 2-a and 2-b are a side view of the base ribbon with labels sticked thereon and a chart showing the light transmissivity of the labeled ribbon, respectively.
Figure 3:
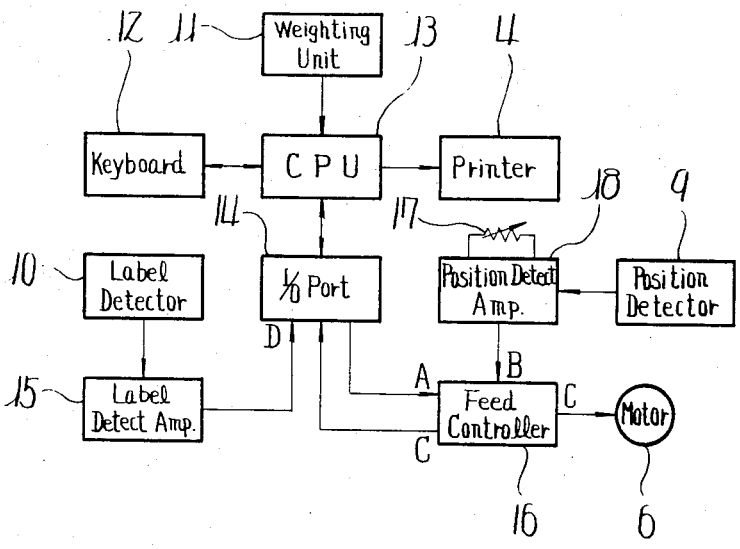
FIG. 3 is a block diagram of the system shown in FIG. 1.
Figure 4:
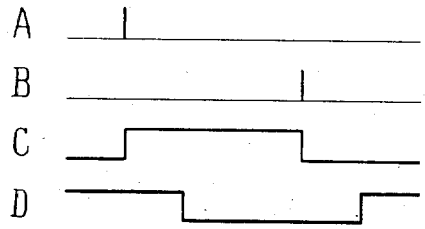
FIG. 4 is a timing chart for the system of FIG. 3.
Figure 5:
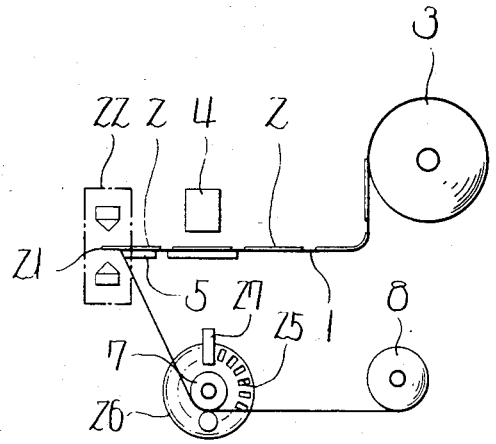
FIG. 5 is a side view of the first embodiment of the present invention.
Figure 6:
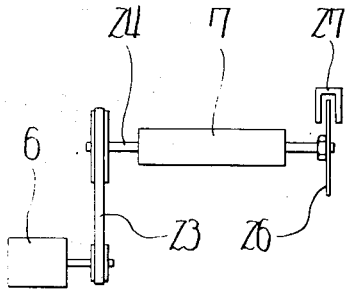
FIG. 6 is a rear view of the feed roller section of the system shown in FIG. 5.
Figure 7:
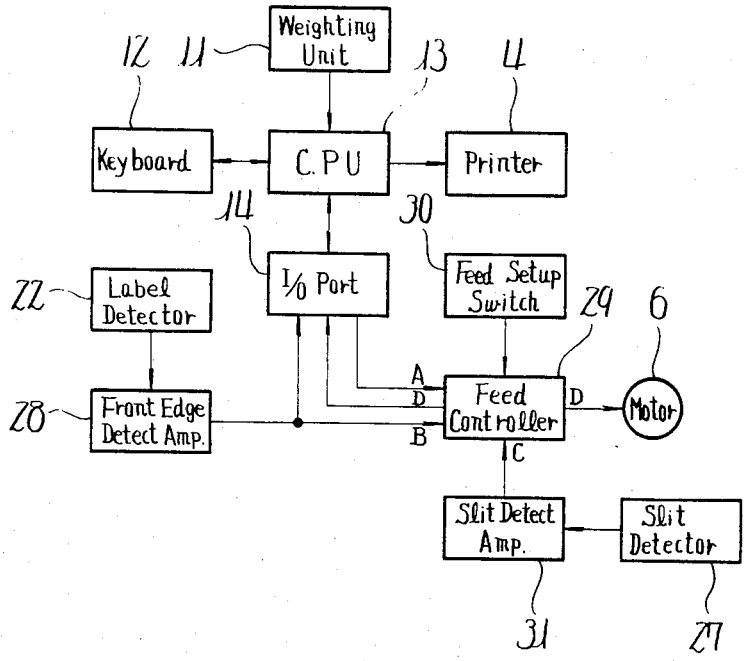
FIG. 7 is a block diagram of the first embodiment system.
Figure 8:
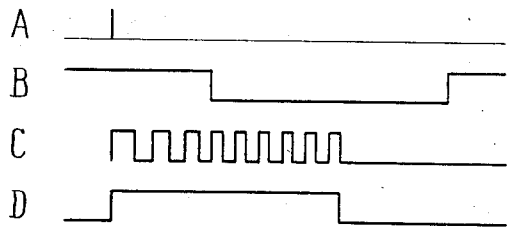
FIG. 8 is a timing chart for the first embodiment system.

The first embodiment of the present invention will now be described with reference to FIGS. 5 through 14, in which the same reference numbers are used for the identical portions shown in FIGS. 1 through 4 and the explanation thereof will be omitted. In this embodiment, a label detector 22 is provided for detecting that the front edge 21 of a label 2 has reached the front of a separator 5 during transportation of the base ribbon 1, and also for detecting the presence of the label 2. On a shaft 24 of a feed roller 7 driven by an induction motor 6 and a belt 23, there is mounted a slit disk 26 with many slits 25 provided on the circumference thereof. Confronting the slit disk 26, there is provided a slit detector 27 for sensing the slits 25.

An I/O port 14 is connected to a CPU 13, and further connected to the label detector 22 through a front edge detection amplifier 28. The I/O port 14 is further connected to a feed controller 29, on which the motor 6 is connected. The feed controller 29 is connected to a feed amount setup unit 30 including a digital switch, and further connected to the slit detector 27 through a slit detection amplifier 31.

In this arrangement, if the label 2 is not located at the label detector 22, the signal B is at a high level, and when the signal A is issued by the CPU 13 with the signal B being high, the feed controller 29 produces a high D-signal to activate the motor 6 for feeding the ribbon 1 and also indicates the signal D to the CPU 13 as an inhibit signal for suppressing other operations during the transportation of the ribbon. At starting of the motor 6, the slit disk 26 rotates slowly due to the inertia of the mechanical components, causing the slit detection amplifier 31 to produce pulse signals C with a large duration. After the initial state, the period of the pulse signal becomes constant. When the base ribbon 1 is transported at a constant feed rate, the label 2 is peeled off the base ribbon, projecting over the separator, and ultimately the front edge 21 of the label 2 is detected by the label detector 22. Then, the signal B from the front edge detection amplifier 28 goes low. The signal B causes the feed controller 29 to start counting the signal C from the slit detector 27. When the count has reached a predetermined number preset by the feed setup switch 30, the signal D goes low to stop the motor 6. Accordingly, the label 2 is stopped following a certain amount of transportation after its front edge 21 has been detected by the label detector 22. In this arrangement, the reference signal is created by the detection of the front edge 21 which provides a large transmissivity difference so far as the label 2 is not transparent and also independence from the printed portion 20 of the label 2, thus resulting in a very accurate detection.

The signal C stays low unless the label 2 is removed, holding the generation of the signal A. Thus, other operations are held and double issue of the label 2 does not occur. Accordingly, the label detector 22 also serves as a detector for sensing the presence of a label as in the case of the conventional system.

Figure 9:
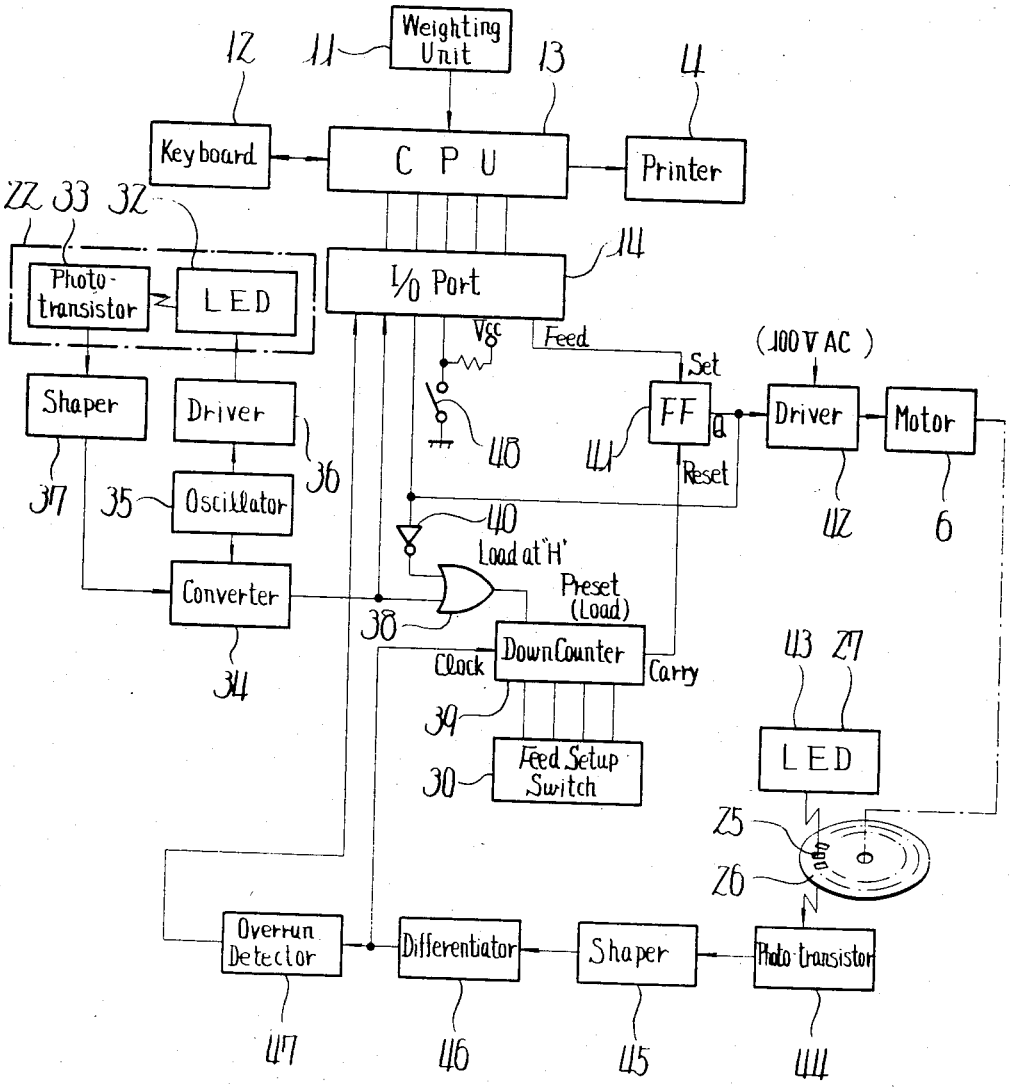
FIG. 9 is a detailed block diagram derived from FIG. 7.

The first embodiment of the invention will further be explained in detail with reference to FIG. 9. FIG. 9 merely particularizes the blocks of FIG. 7, and has no difference in the basic operation. The label detector 22 consists of a light emitting diode (LED) 32 and a photo-transistor 33, and the LED 32 is connected through a driver 36 to an oscillator 35 which is also connected to a converter 34. The photo-transistor 33 is connected through a waveform shaper 37 to the converter 34. The oscillator 35 oscillates in a frequency of about 3 kHz so that the LED 32 emits light pulses periodically. The converter 34 converts the pulse output from the photo-transistor 33 into the DC voltage signal having a high and low levels. The output of the converter 34 goes high when the label 2 is absent, and it goes low when the label exists. The purpose of using such flashing light is to prevent the effect of external light and also to provide an intensified light to the LED 32 which is located far from the photo-transistor 33, so as to enhance the reliability of the detection.

The converter 34 is connected to the I/O port 14 and to an OR gate 38 which is connected to a down-counter 39, a principal constituent of a means for feeding the ribbon at a constant pitch. The down-counter 39 is connected to the feed setup switch 30. Another input of the OR gate 38 is connected to an inverter 40, the input of which is connected to the I/O port 14 and to the output Q of a flip-flop 41. The set and reset inputs of the flip-flop 41 are connected to the I/O port 14 and the down counter 39, respectively. The output of the flip-flop 41 is connected through a driver 42 to the motor 6.

The slit detector 27 confronting a slit disk 26 consists of a LED 43 and a photo-transistor 44, and the photo-transistor 44 is connected through a waveform shaper 45 to a differentiator 46 which differentiates the rise and fall transitions of input pulses to produce pulses twice the original pulses derived from the slits 25. The differentiator 46 is connected to the down-counter 39 and also to an overrun detector 47 which is connected to the I/O port 14. Also connected to the I/O port 14 is a print mode selector switch 48 which selects 1-line printing or 2-line printing.

In this arrangement, when the label 2 is absent from the label detector 22, or when the flip-flop 41 is reset, the OR gate 38 outputs a high level to load the down-counter 39 with the contents of the feed setup switch 30. This operation may be considered as presetting, since the down-counter 39 is loaded irrespective of its initial contents when a high level is given by the OR gate 38. In this state, when the flip-flop 41 receives a feed signal from the I/O port 14, it is set, causing the inverter 40 to output a low level and, at the same time, supplying the motor 6 with the 100 VAC power voltage through the driver 42. Then, the motor 6 rotates to feed the base ribbon 1 and, at the same time, the rotating slit disk 26 causes the photo-transistor 44 to emit pulses which, in turn, is supplied to the down-counter 39 as the clock signal. The down counter 39, however, does not change its contents, because it still receives a high level from the converter 34.

While the time elapses in this state, the front edge 21 of the label 2 is detected by the label detector 22, and the output of the converter 34 goes low to release loading to the down-counter. From this moment, the down-counter 39 receives pulses derived from the slit detector 27 to decrement its contents. When the down-counter 39 becomes empty, the flip-flop 41 is reset, causing the motor 6 to stop, and then the down-counter 39 is loaded again.

In so doing, transportation of the ribbon 1 is stopped after a certain amount of feed following the detection of the front edge 21 of the label 2.

Figure 10:
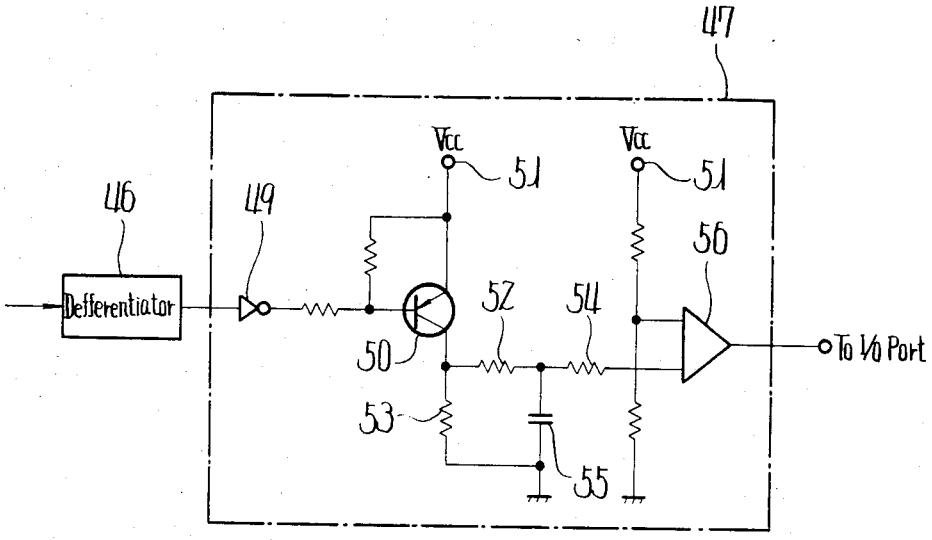
FIGS. 10 and 11 are circuit diagrams of the timers.
Figure 11:
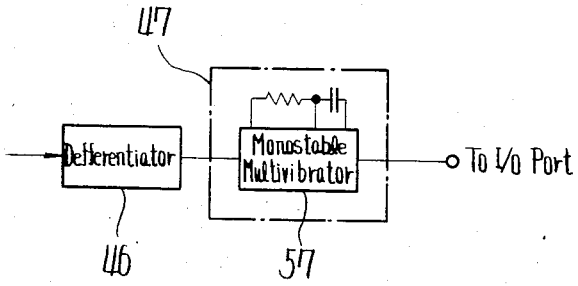

An overrun detector 47 detects the overrun of the ribbon 1, which could occur after the motor 6 has stopped, sending a signal having a certain duration to the CPU 13 following the deactivation of the motor 6 so that any other operation is held during the overrun in order to prevent malfunctioning. FIGS. 10 and 11 show examples of the circuit arrangement used for the overrun detector 47.

In the arrangement of FIG. 10, the differentiator 46 is connected through an inverter 49 to a transistor 50, the emitter thereof being connected to a power source 51, with the collector being connected to a comparator 56 through resistors 52, 53 and 54 and a capacitor 55. The comparator 56 is supplied with the power voltage divided by resistors 57 and 58, and its output is connected to the I/O port 14. Accordingly, when pulses are supplied from the differentiator 46, the transistor 50 turns on each time to charge the capacitor 55, and the voltage to the comparator 56 is maintained constant. When the differentiator 46 halts to send pulses, the transistor 50 is cut off steadily, causing the capacitor 55 to discharge. Then, the comparator 56 outputs a low level signal indicating that the slit disk 26 has stopped rotating. If the transistor 50 receives pulses even in a low rotational speed of the disk, the capacitor 55 is charged, and overrunning of the ribbon 1 can be checked surely.

The overrun detecting circuit as exemplified in FIG. 11 employs a monostable multivibrator 57 having a predetermined ON-time. The monostable multivibrator 57 is re-set by incoming pulses so as to retain the ON-state, however, if it fails to receive a pulse within a certain interval, it produces a low output signal to halt the operation.

Figure 12:
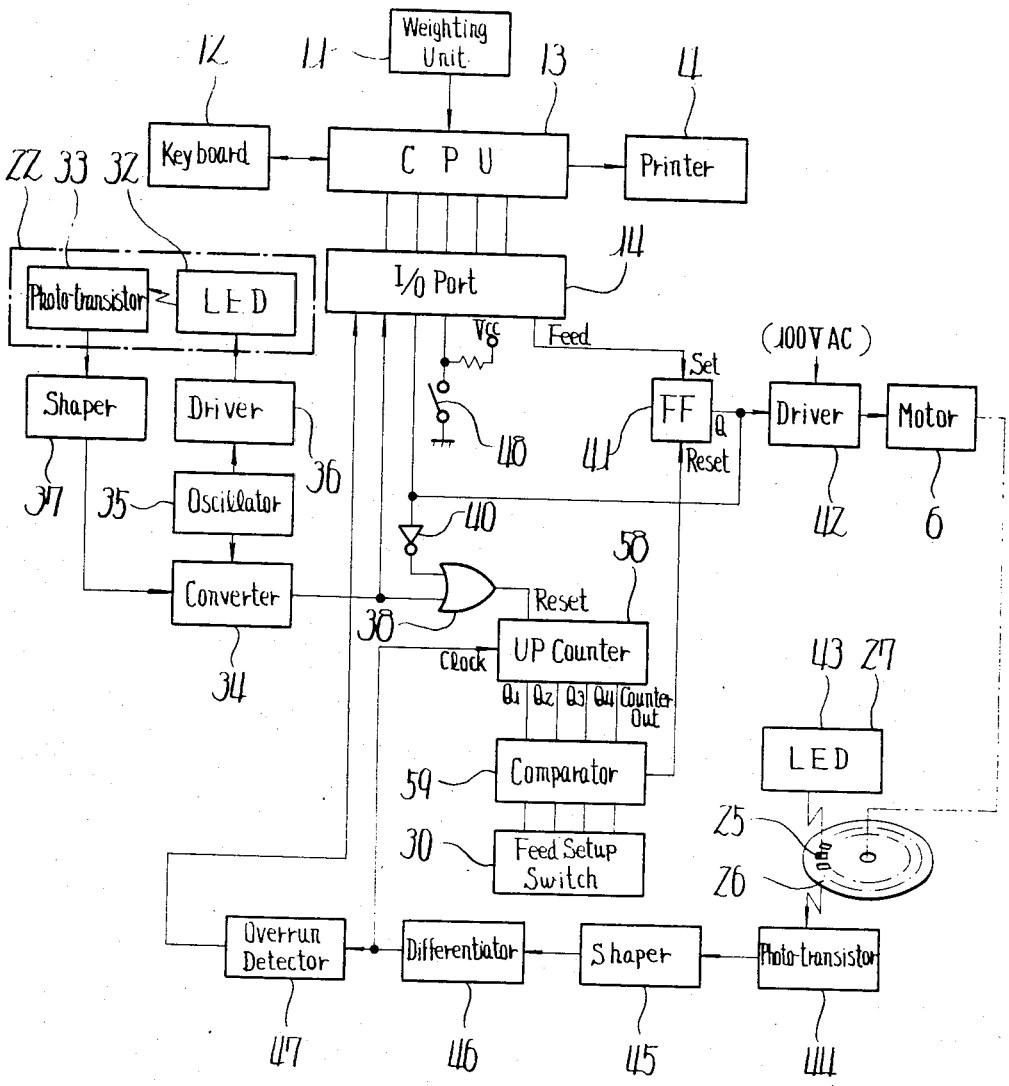
FIG. 12 is a block diagram showing the alteration of the system of FIG. 9.

Whereas the above embodiment employs the down-counter 39, more simplified circuit arrangement is shown in FIG. 12, in which an up-counter 58 is used instead of the down-counter 39 so as to provide an inexpensive means for feeding the ribbon at a constant pitch. Between the up-counter 58 and the feed setup switch 30 there is connected a comparator 59, the output of which resets the flip-flop 41 when the output of the counter 58 coincides with the output of the setup switch 30. When the flip-flop 41 is reset or the label 2 is removed from the label detector 22, the OR gate 38 produces a high output to clear the up-counter 58.

Figure 13:
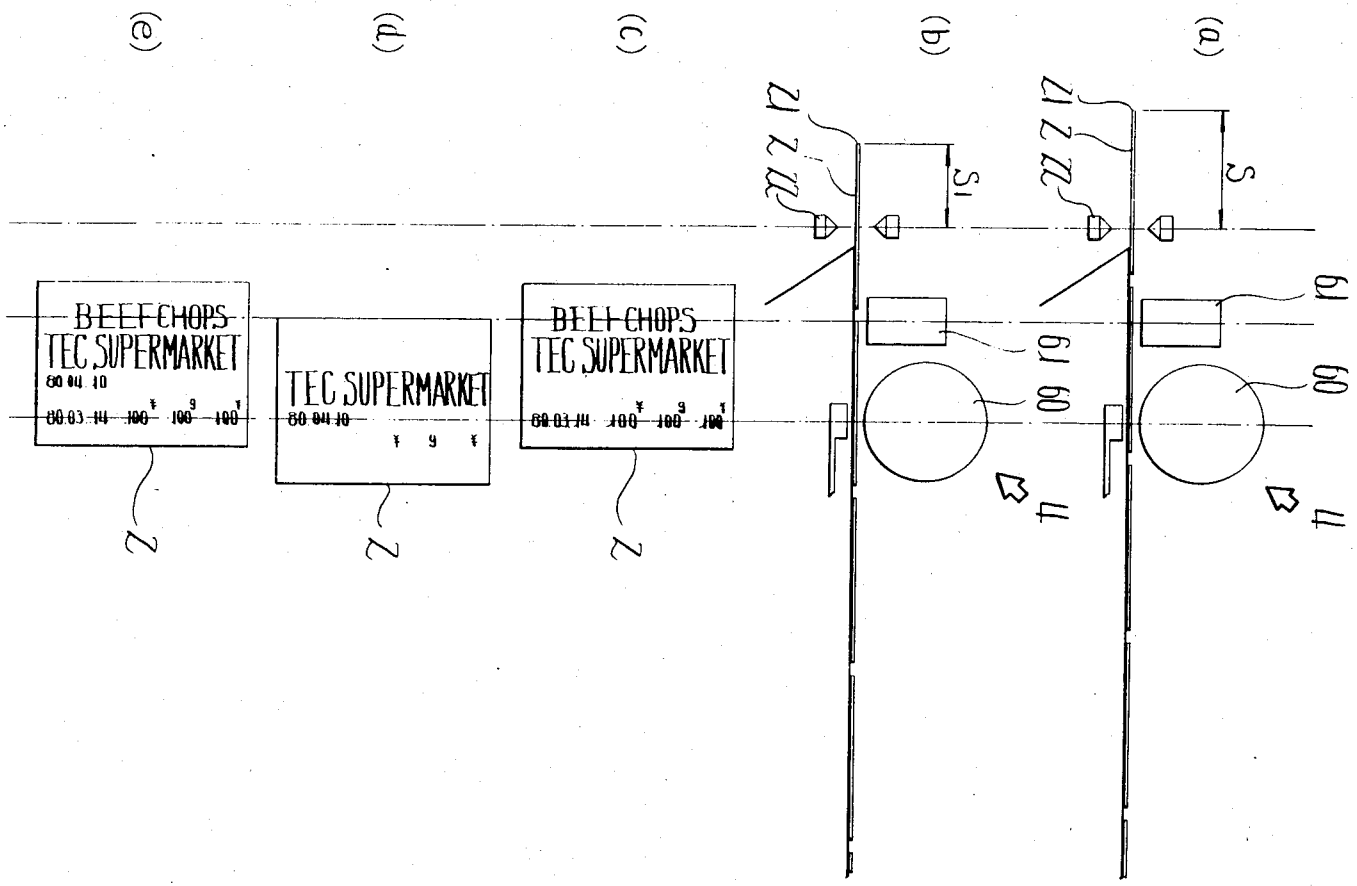
FIG. 13 is a set of illustration explaining the spatial relationship between the printer and the label for 1-line printing and 2-line printing modes.

A means for 2-line printing will now be described with reference to FIGS. 13 and 14. The 2-line printing denotes the operation for printing numeric data on two lines on the label 2, wherein label transportation has to be divided into two steps because of the single line printing unit and also a narrow line spacing. FIG. 13 shows the spatial relationship between the printer 4 and the label 2. FIGS. 13-a and 13-c are for the case of 1-line printing. The printer 4 consists of a data printing unit 60 such as a line printer head and a stamp 61 for printing the commodity name and the like, and the label 2 has a printed portion 20 reading as "TEC SUPERMARKET", the name of a store. The label 2 is detected at its front edge 21 by the label detector 22, and still transported for a length of S by the means as mentioned above, then it stops. In this state, the label projecting over the label detector 22 is peeled off the base ribbon 1, and the data printing unit 60 and the stamp 61 operate simultaneously in response to the command of issue so as to print the commodity name "BEEF CHOPS", the manufacturing data "800314", the unit price "100", the weight "100" and the amount "100". Printing is then followed by label transportation as described previously.

However, if another data such as the data of storage limit needs to be printed in addition to the above-mentioned data, it must be printed on another line because the first line is already full. This is the 2-line printing, and shown in FIG. 13-e as the data for the storage limit, "800410", printed on the separate line from that for the unit price, etc. For 2-line printing, the label 2 is transported for a length of S1 following the detection of its front edge 21, as shown in FIG. 13-b, so that this position gives the reference position in 2-line printing. On condition that the projecting label 2 has been taken, the date of storage limit is first printed as shown in FIG. 13-d, then the label is further transported to the position as shown in FIG. 13-a. This feed control, as will be described later, does not make reference to the detection of the front edge 21, but is subjected to incremental feed control based on the predetermined number of slits 25 of the slit disk 26. After the commodity name and data have been printed, the label 2 is further transported and then stopped with its front edge 21 projecting over the label detector 22 by a length of S1, as shown in FIG. 13-b.

Figure 14:
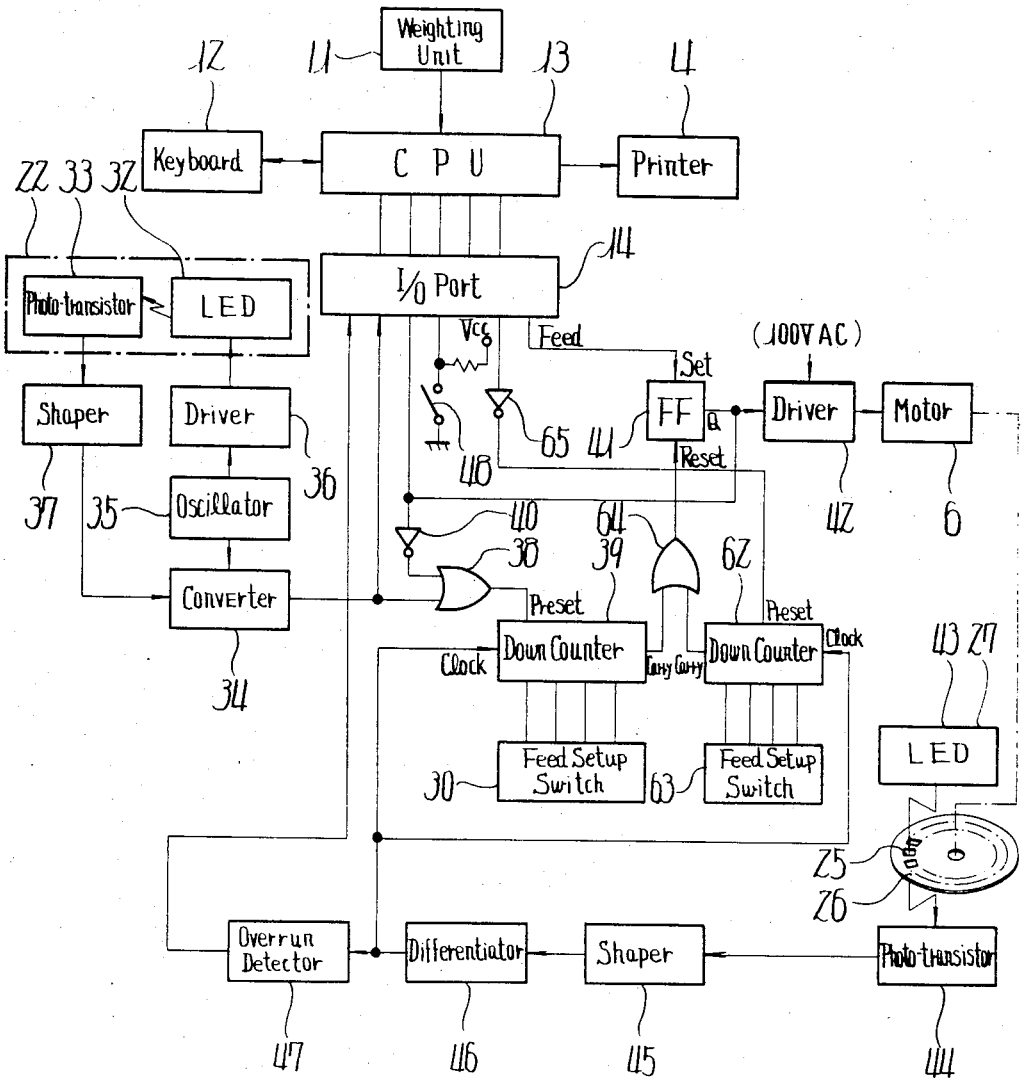
FIG. 14 is a block diagram of the system capable of 2-line printing.

Such feed control is performed by the circuit arrangement shown in FIG. 14 which is a modified version of FIG. 9, including an additional down-counter 62 and an additional feed setup switch 63. The down-counter 62 is connected to the differentiator 46 in conjunction with the first-mentioned down-counter 39, and the outputs of the down-counters 39 and 62 are connected through an OR gate 64 to the flip-flop 41. The down-counter 62 is connected to receive the 1-FEED signal from the I/O port 14 through an inverter 65.

When the print mode switch 48 is set to the 2-LINE printing position, the label will be located as shown in FIG. 13-b. The former-going label 2 has been removed. In this state, the signal 1-FEED is at high and a low level signal is given to the down-counter 62 so that it is released from loading. When the flip-flop 41 is set by the feed signal, the motor starts rotating. Consequently, the slit disk 26 is driven to rotate, causing the differentiator 46 to send pulses to the down-counter 62 for decrementing its contents. At this time, another down-counter 39 receives a high level signal from the OR gate 38, and it does not change its contents. When the down-counter 39 becomes empty, the flip-flop 41 is reset, causing the motor 6 to stop. The label 2 is positioned as shown in FIG. 13-a (the former-going label has been removed), and it is printed by the printer 4. When the feed signal is issued next, the 1-FEED signal goes low and a high level signal is given to the down-counter 62 for recurrence of loading. At the same time, the flip-flop 41 is set to activate the motor 6. When the label detector 22 detects the front edge 21 of the label 2, the output of the OR gate 38 goes low, causing the output of the differentiator 46 to decrement the contents of the down-counter 39. When the down-counter 39 becomes empty, the flip-flop 41 is reset and the motor 6 is stopped. At this time, the label 2 is located as shown in FIG. 13-b.

Figure 15:
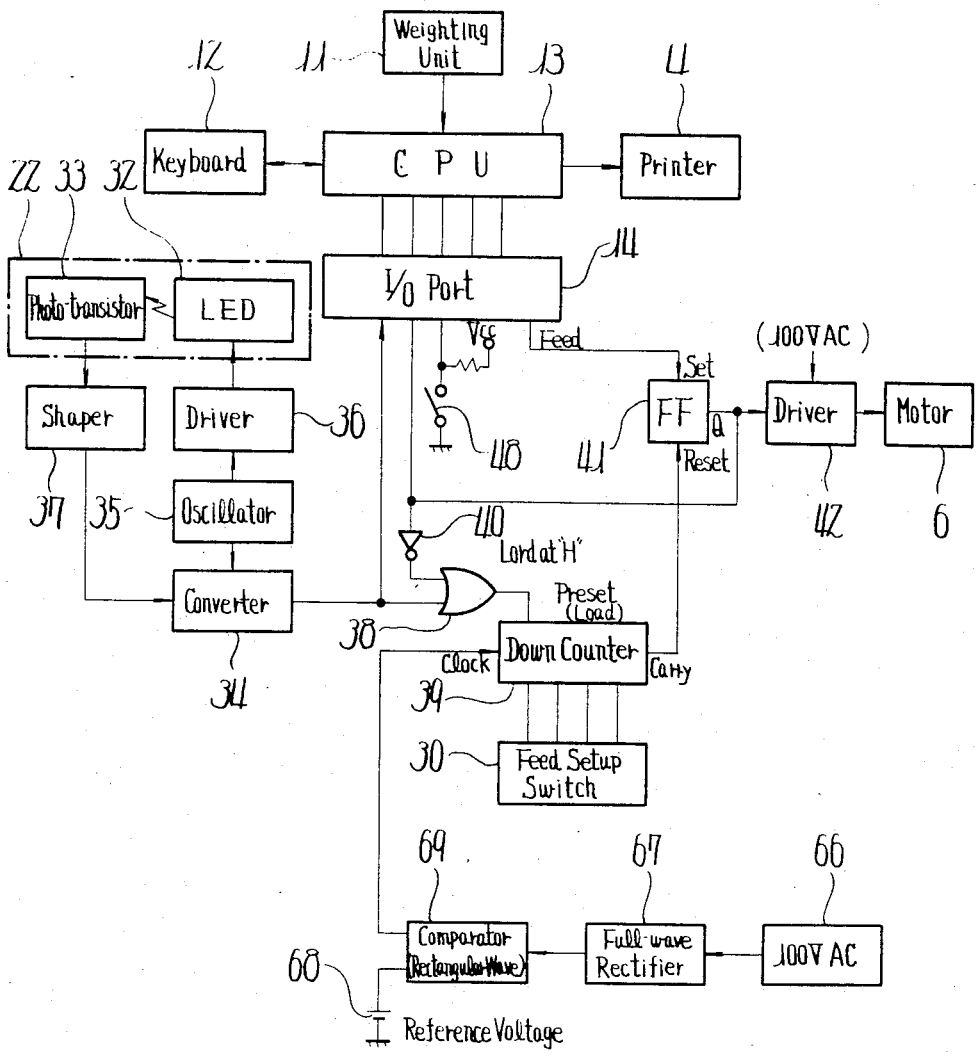
FIG. 15 is a block diagram showing the second embodiment of the invention.

The second embodiment of the present invention will now be described with reference to FIG. 15, in which the same reference numbers are used for the identical portions in the previous figures and the explanation thereof will be omitted. This rule will refer to all subsequent embodiments for purposes of simplicity. A full-wave rectifier 67 is connected to an AC power source 66, and a ripple current from the full-wave rectifier 67 is conducted to a comparator 69 which converts the ripple voltage into a rectangular wave signal on the basis of a reference voltage established by a reference level setup battery 68. The output of the comparator 69 is connected to the down-counter 39.

The feed setup switch 30 has been set in advance with the number of cycles of the power frequency such that the setup number corresponds to the amount of feed. The comparator 69 normally produces pulses, which, however, are not received by the down-counter 39 so far as the OR gate 38 outputs a high level. When a feed signal sets the flip-flop 41, the motor 6 operates to feed the label 2. Then, the label detector 22 detects the front edge 21 of the label 2, causing the OR gate 38 to produce a low level, and the output of the comparator 69 is received by the down-counter 39. When the down-counter 39 becomes empty, it resets the flip-flop 41 to stop the motor 6. Accordingly, the amount of feed after the front edge 21 of the label has been detected is set up basing on the power frequency.

In this case, the motor 6 used is of the type which provides rotation in synchronization with the power frequency, such as that known as the synchronous motor.

Figure 16:
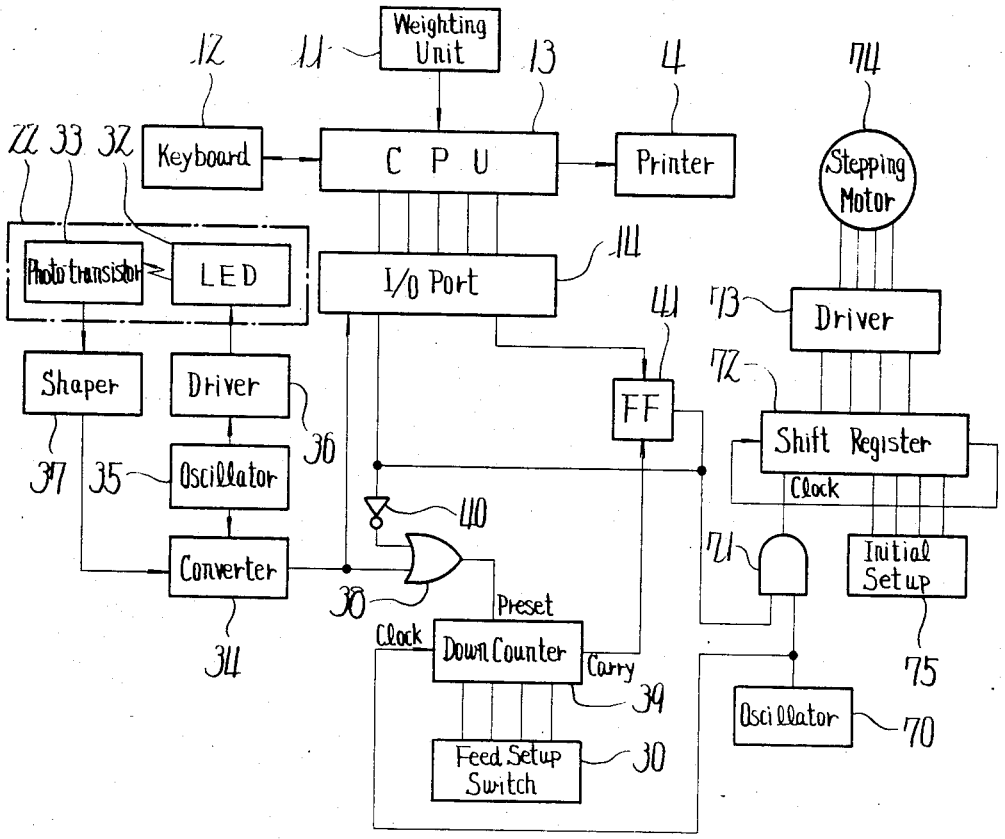
FIG. 16 is a block diagram showing the third embodiment of the invention.

The third embodiment of the invention will be described with reference to FIGS. 16 through 19, wherein a stepping motor is employed as a drive actuator. FIG. 16 shows an example of such arrangement and FIGS. 17 through 19 refer to another example.

In FIG. 16, an oscillator 70 is connected to the clock input of the down-counter 39 and one input of an AND gate 71. Another input of the AND gate 71 is connected to the output of the flip-flop 41, with the output of the AND gate connected to the clock input of a shift register 72. The parallel outputs of the shift register 72 are connected through a driver 73 to a stepping motor 74. The shift register 72 has the preset inputs connected to an initial setup circuit 75 which defines the initial state of the stepping motor 74.

When a feed signal is issued, the flip-flop 41 is set and the AND gate 71 conducts the signal from the oscillator 70. Then, the stepping motor 74 rotates at a speed depending on the frequency of the oscillator 70, and the label 2 is fed. At this time, the down-counter 39 does not change its contents unless the label detector 22 detects the label 2. When the label detector 22 detects the front edge 21 of the label 2, the output of the OR gate 38 goes low, causing the down-counter 39 to receive the output of the oscillator 70 for decrementing its contents. When the down-counter 39 becomes empty, the flip-flop 41 is reset and the AND gate 71 ceases the conduction of the oscillator output. Then, the stepping motor 74 stops to halt the transportation of the label 2.

Figure 17:
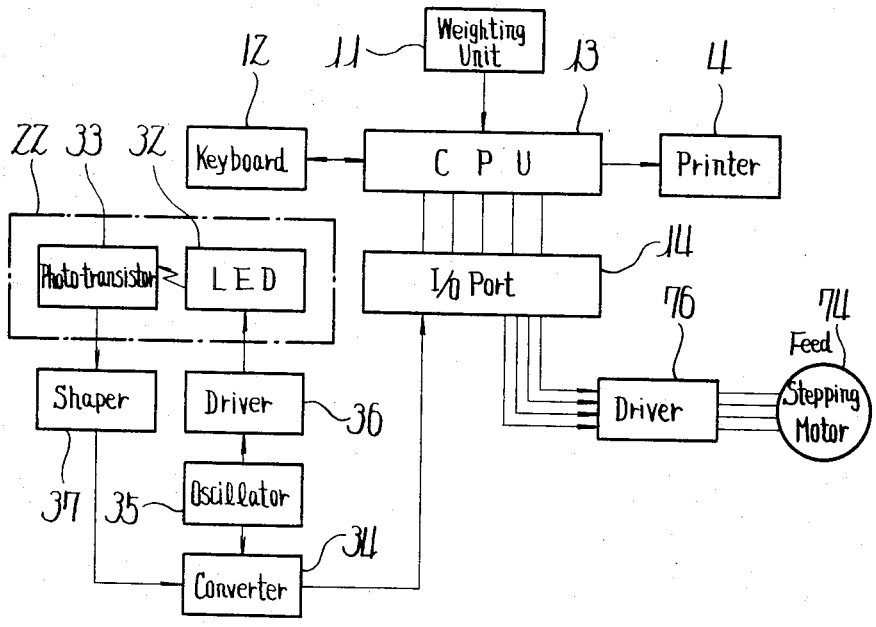
FIG. 17 is a block diagram showing another embodiment of the invention.
Figure 18:
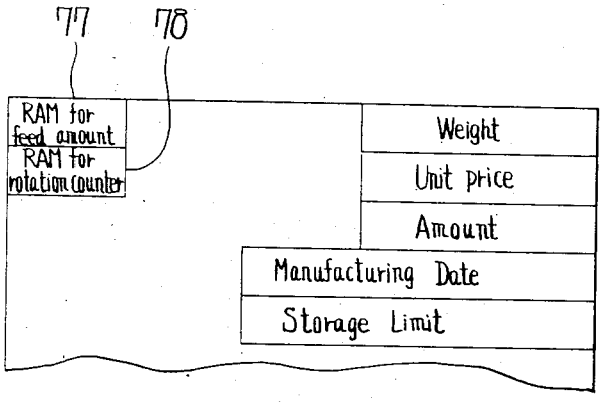
FIG. 18 is a chart showing the RAM map of the system.
Figure 19:
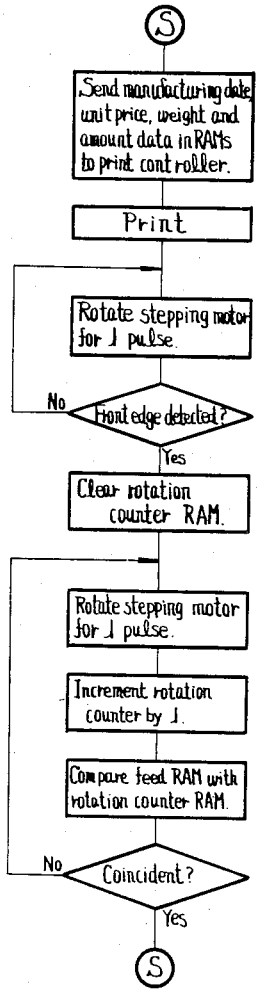
FIG. 19 is a flowchart for the system of FIG. 17.

In another example shown in FIGS. 17 through 19, the stepping motor 74 is operated under program control. The label detector 22 is connected through the waveform shaper 37 to the converter 34, the output of which is connected to the I/O port 14. The I/O port 14 is connected to the CPU 13, and is also connected through a driver 76 to the stepping motor 74. The CPU 13 has a RAM 77 adapted to operate as a feed setup unit and a RAM 78 adapted to operate as a rotation counter.

First, data of the manufacturing date, unit price, weight and amount are transferred to the print controller before they are printed by the printer 4. After the data have been printed, the stepping motor 74 is rotated by one pulse. The stepping motor 74 goes on stepping to feed the label 2 until the label detector 22 detects the front edge 21 of the label 2. When the label detector 22 detects the front edge 21, the rotation counter RAM 78 is cleared. Subsequently, the stepping motor 74 rotates by one pulse, incrementing the rotation counter RAM 78 by one, then the contents of the counter RAM 78 is compared with the contents of the feed setup RAM 77, which has been preset to a certain number. The rotation counter RAM 78 is incremented by one continuously until the comparison results in a coincidence. When the coincidence of the RAMs is reached, the stepping motor 74 stops to complete a cycle of operation.

Figure 20:
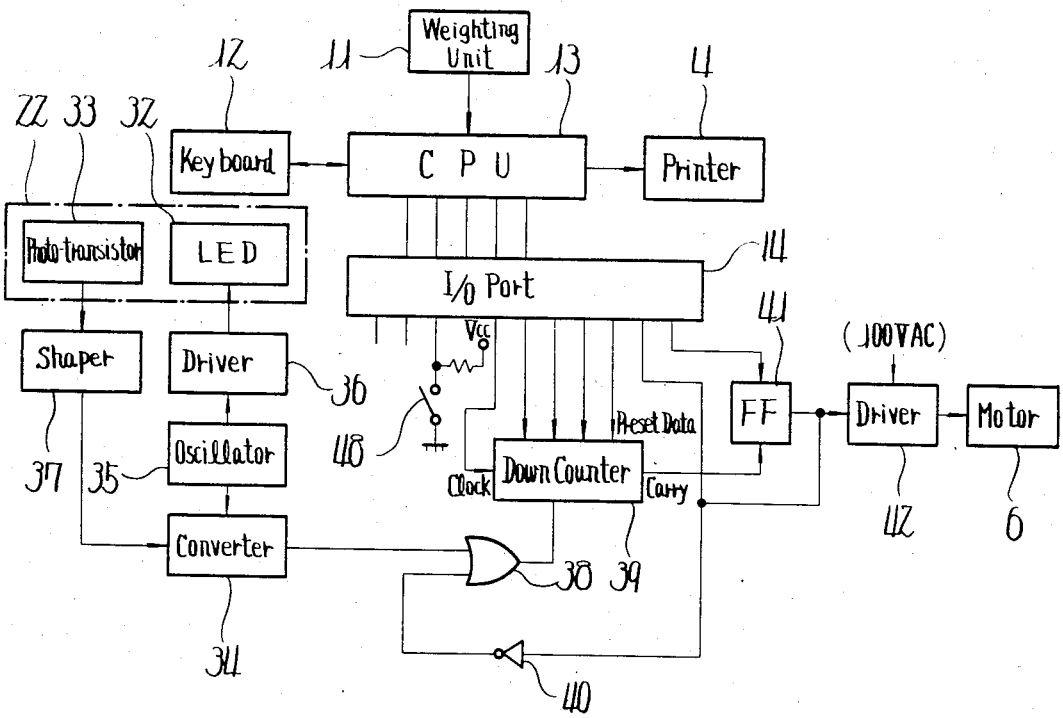
FIG. 20 is a block diagram showing the fourth embodiment of the invention.

The fourth embodiment of the invention will be described with reference to FIGS. 20 through 23. In this embodiment, a ten-key is used to set the amount of feed and the motor 6 is operated under program control. In FIG. 20, the down-counter 39 is arranged to load data when a flip-flop 41 is reset or when the label detector 22 detects the label as in the case of the arrangement shown in FIG. 9. The down-counter 39, however, is directly connected to the I/O port 14 so that it is loaded with feed data, and a clock is supplied from the I/O port 14.

Figure 21:
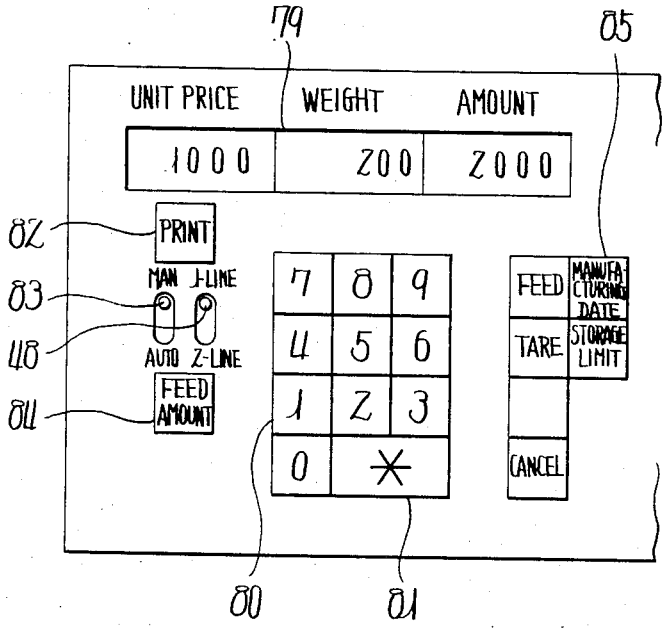
FIG. 21 is a plan view of the keyboard.

FIG. 21 shows the layout of the keyboard, which includes a read out unit 79 divided into UNIT PRICE, WEIGHT and AMOUNT, a ten-key 80 for entering numeric data, an EXECUTION key 81, a PRINT key 82, a MAN/AUTO mode selector switch 83, a 1-LINE/2-LINE print mode selector switch 48, and a FEED AMOUNT key 84. The keyboard is further provided with the function keys including a FEED key, a WARE key, a MANUFACTURING DATE setup key, a STORAGE LIMIT setup key, and a CANCEL key. The RAM is allocated as shown in FIG. 18.

Figure 22:
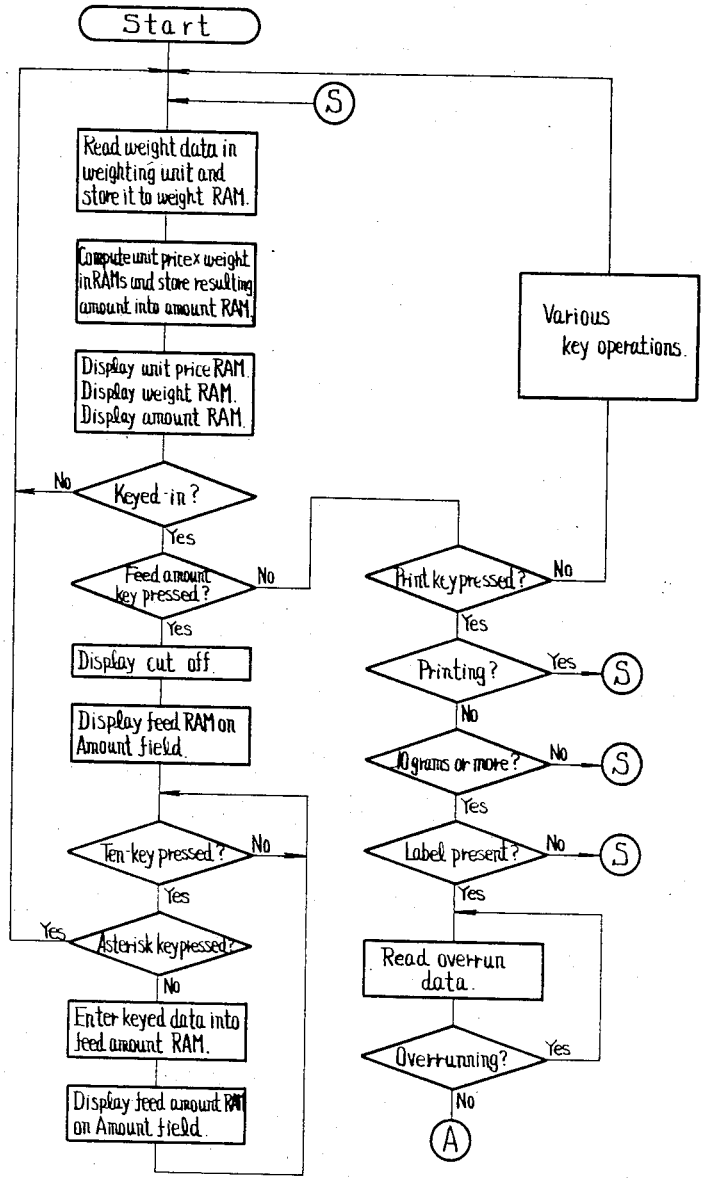
FIGS. 22 and 23 are flowcharts for the fourth embodiment system.

On the flowchart of FIG. 22, when the system starts, a weight data derived from the weighing unit 11 is loaded to the weight RAM. The weight data is multiplied with the contents of the unit price RAM which has been preset, and the result is stored in the amount RAM. The contents of the unit price RAM, weight RAM and amount RAM are displayed on the respective divisions of the read out unit 79. Then, setup of operational modes such as the MAN/AUTO mode are checked. After entry for these keys has been confirmed, entry of the FEED AMOUNT key 84 is checked.

Entry of the FEED AMOUNT key 84 specifies the amount of feed of the label 2 after its front edge 21 has been detected by the label detector 22. When the FEED AMOUNT key 84 is pressed, the read out unit 79 is turned off, and the contents of the feed amount RAM 77 are displayed on the AMOUNT section of the read out unit 79. Using the ten-key 80, a new setup data is entered into the feed amount RAM 77 and displayed on the read out unit 79 for confirmation. By pressing the EXECUTION key 81, the amount of feed is set, and the unit price, weight and amount are displayed again on the read out unit 79.

After the amount of feed has been set or the previous setting is not changed, the system operates according to the key entry. When the PRINT key 82 is pressed, it is checked if printing is being carried out. During printing, control returns to S, or if not, the weight data is checked if it is 10 grams or more. This checking verifies if a commodity is surely loaded to the weighing unit 11, and at the same time, various checks for the weighing unit, such as the overflow of the amount are carried out. Detection of the label by the label detector 22 is as follows. If the label is detected, control returns to S in order to prevent a double issue of the label, and if the label is not detected, overrun data is read in. The overrun data is provided by an overrun detecting device which is not shown in FIG. 20. The system waits until the overrun ends, and then proceeds to point A on the flowchart.

Figure 23:
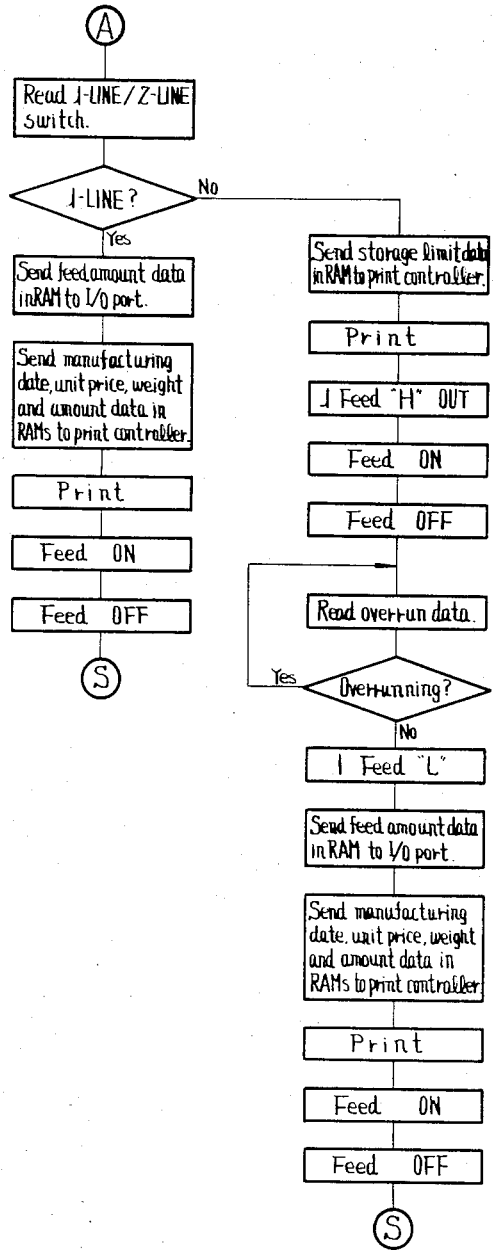

From point A, the process continues as shown on the flowchart of FIG. 23. The selector switch 48 is read in for checking if the print mode is 1-line printing or 2-line printing. For 1-line printing, the contents of the feed amount RAM 77 are conducted to the I/O port 14 so as to load the down-counter 39. The contents of the manufacturing date, unit price, weight and amount RAMs are conducted to the print controller so that they are printed on the label 2 by the printer 4. Then, the label is fed by setting the flip-flop 41 through the I/O port 14. When the label detector 22 detects the front edge 21 of the label 2, a low level is given from the OR gate 38 to the down-counter 39, which is then decremented by the clock. When the down-counter 39 becomes empty, the flip-flop 41 is reset and label feed is halted. Control then returns to point S.

Although the circuit arrangement for 2-line printing is not shown in FIG. 20, the operation of 2-line printing will be described with reference to the flowchart of FIG. 23.

The contents of the storage limit RAM are conducted to the print controller and printed by the printer 4. Then, the 1-FEED signal is issued to feed the label 2 for a certain amount. Overrun data is read in, and the signal 1-FEED is made low while overrun does not occur, so that the contents of the feed amount RAM 77 are output to the I/O port 14. The contents of the manufacturing date, unit price, weight and amount RAMs are conducted to the print controller and printed by the printer 4. After printing, the label 2 is fed for a certain length, making reference to the front edge detection by the label detector 22. After feeding has halted, control returns to point S.

Figure 24:
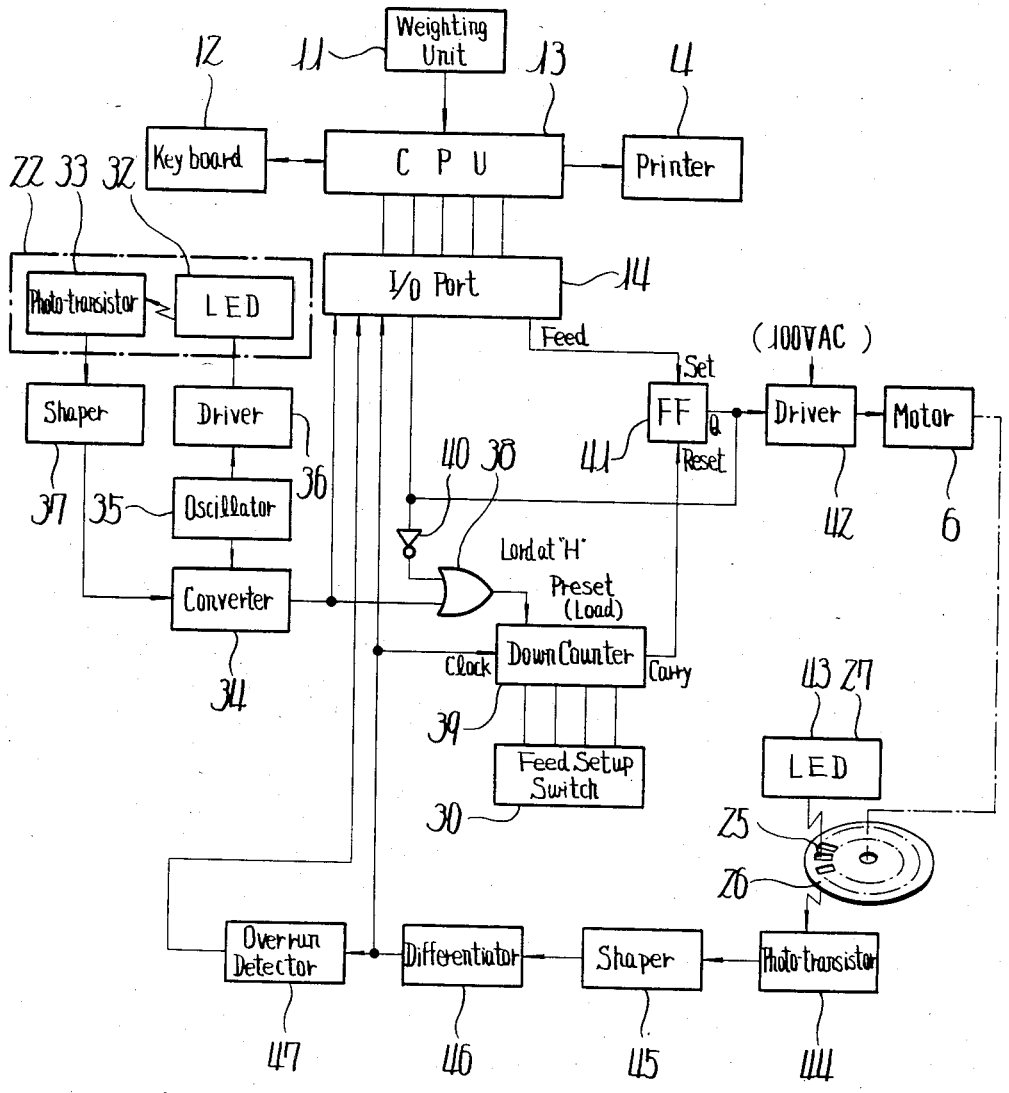
FIG. 24 is a block diagram showing the fifth embodiment of the invention.
Figure 25:
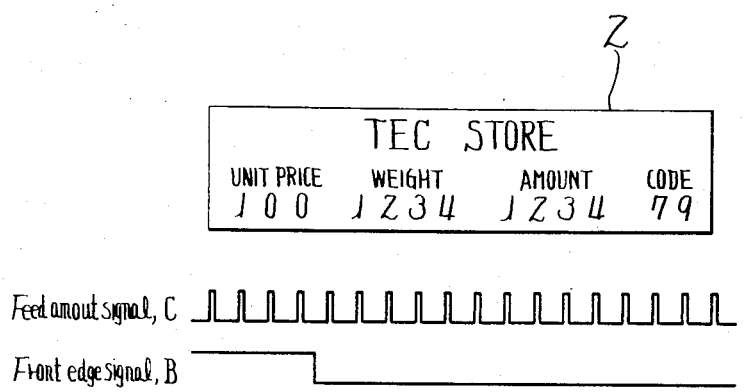
FIG. 25 is a set of illustration showing the relationship between the print form of the label and the signals.
Figure 26:
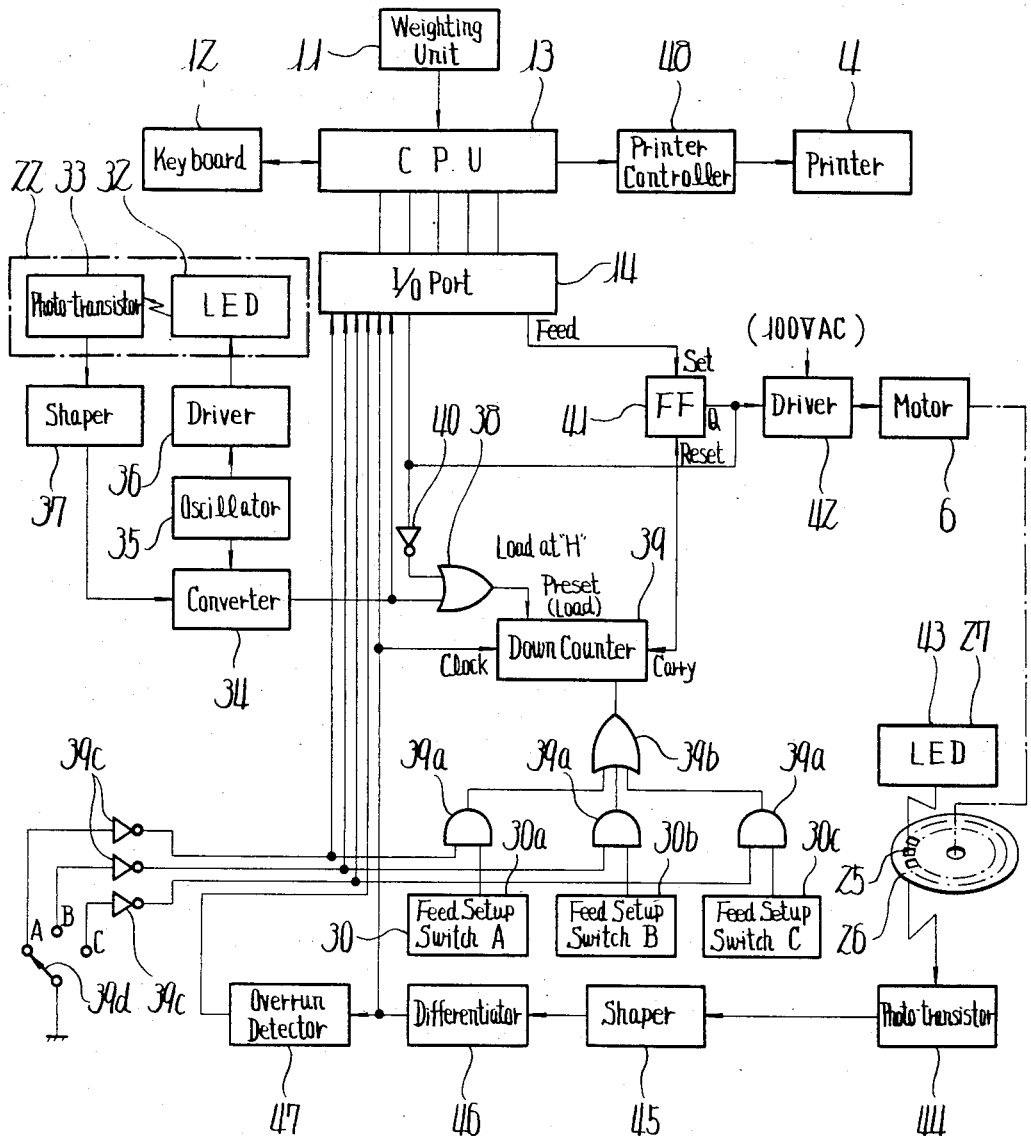
FIG. 26 is a block diagram showing the sixth embodiment of the invention.

The fifth embodiment of the invention will be described with reference to FIGS. 24 and 25, in which the same reference numbers are used for the identical portions shown in the previous embodiments and the explanation thereof will be omitted. A label detector 22 consists of an LED 32 and a photo-transistor 33. The LED 32 is connected through a driver 36 to an oscillator 35 which is connected to a converter 34. The photo-transistor 33 is connected through a waveform shaper 37 to the converter 34. The oscillator 35 supplies pulses of about 3 kHz to the LED 32 so that it emits light pulses periodically. The converter 34 converts the pulse output from the photo-transistor 33 into a DC voltage signal having a high and low levels. The output of the converter 34 goes high when the label 2 is absent from the detector 22, and goes low when the label exists. The purpose of using such flashing light in detecting the label is to prevent the effect of external light and also to provide an intensified light to the LED 32 which is located far from the photo-transistor 33, so as to ensure the reliability of the detection.

The converter 34 is connected to an I/O port 14 and to an OR gate 38 which is connected to a down counter 39, a principal constituent of a means for feeding the ribbon at a constant pitch. The down-counter 39 is connected to a feed setup switch 30. Another input of the OR gate 38 is connected to an inverter 40, the input of which is connected to the I/O port 14 and to the output Q of a flip-flop 41. The set and reset inputs of the flip-flop 41 are connected to the I/O port 14 and the down-counter 39, respectively. The output of the flip-flop 41 is connected through a driver 42 to a motor 6.

A slit detector 27 confronting a slit disk 26 consists of an LED 43 and a photo-transistor 44, and the photo-transistor 44 is connected through a waveform shaper 45 to a differentiator 46 which differentiates the rise and fall transitions of input pulses to produce pulses twice the original pulses derived from the slits 25. The differentiator 46 is connected to the down-counter 39 and also to the I/O port 14. The differentiator 46 is further connected to an overrun detector 47, which is connected to the I/O port 14.

In this arrangement, when the label 2 is absent from the label detector 22, or when the flip-flop 41 is reset, the OR gate 38 outputs a high level to load the down-counter 39 with the contents of the feed setup switch 30. This operation may be considered as presetting, since the down-counter 39 is loaded irrespective of its initial contents when a high level is given by the OR gate 38. In this state, when the flip-flop 41 receives a feed signal from the I/O port 14, it is set, causing the inverter 40 to output a low level signal and, at the same time, supplying the motor 6 with the 100 VAC power voltage through the driver 42. Then, the motor 6 rotates to feed the ribbon 1, and at the same time the rotating slit disk causes the photo-transistor 44 to emit pulses which, in turn, is supplied to the down-counter 39 and the I/O port as the clock signal. The down-counter 39, however, does not change its contents, because it still receives a high level from the converter 34. The I/O port 14 is supplied with the clock signal from the photo-transistor 44, and this signal or a divided clock is used to produce the print command which is supplied to the printer 4 as a timing signal for printing. This printer 4 is different from one shown in FIG. 1, but, for example, a label printer for merely printing a single line, and it prints characters sequentially from the left end of the label 2 in accordance with the feed signal as shown in FIG. 25.

While the time elapses in this state, the front edge 21 of the label 2 is detected by the label detector 22, and the output of the converter 34, i.e. the front edge detection signal B, goes low to release the down-counter from loading. From this moment, the down-counter 39 receives pulses derived from the slit detector 27 to decrement its contents. When the down-counter 39 becomes empty, the flip-flop 41 is reset, causing the motor 6 to stop, and the down-counter 39 is loaded again.

After the front edge 21 of the label 2 has been detected, the label is printed while it is being fed at a certain pitch, then transportation of the ribbon 1 is halted.

The overrun detector 47 detects the overrun of the ribbon 1 which could occur after the motor 6 has stopped, sending a signal having a certain duration to the CPU 13 following the deactivation of the motor 6 so that any other operation is held during the overrun in order to prevent malfunctioning.

In the above embodiment, a line printer is used as the printer 4, however, a dot-matrix printer may be used. In this case, a small-pitch slit disk is employed as the slit disk 26, and its output is delivered to a character generator for carrying out print control.

The sixth embodiment of the invention will be described with reference to FIGS. 26 through 31.

The sixth embodiment of the invention will be described with reference to FIGS. 26 through 31. A label detector 22 is made up of an LED 32 and a photo-transistor 33. The LED 32 is connected through a driver 36 to an oscillator 35 which is in connection with a converter 34. The photo-transistor 32 is connected through a waveform shaper 37 to the converter 34. The oscillator 35 supplies pulses of about 3 kHz to the LED 32 so that it emits light pulses periodically. The converter 34 converts the pulse output from the photo-transistor 33 into a DC voltage signal having a high and low levels. The output of the converter 34 goes high when the label 2 is absent from the detector 22, and goes low when the label exists. The purpose of using such flashing light in detecting the label is to prevent the effect of external light and also to provide an intensified light to the LED 32 which is located far from the photo-transistor 33, so as to enhance the reliability of the detection.

The converter 34 is connected to an I/O port 14 and an OR gate 38 which is in connection with a down-counter 39, a principal constituent of a means for feeding the ribbon at a constant pitch. The down-counter 39 is connected to three feed setup switches 30*a*, 30*b* and 30*c* indicated as A, B and C, through three AND gates 39*a*, and an OR gate 39*b*. Another inputs of the three AND gates 39*a* are connected through three inverters 39*c* to a print format selector switch 39*d* having three selecting contancts, A, B and C. One input of the OR gate 38 is connected to the output of an inverter 40 with its input connected to the I/O port 14 and also to the output Q of a flip-flop 41. The set and reset inputs of the flip-flop 41 are connected to the I/O port 14 and the down-counter 39, respectively, with its output connected through a driver 42 to a motor 6.

A slit detector 27 confronting a slit disk 26 consists of an LED 43 and a photo-transistor 44, and the photo-transistor 44 is connected through a waveform shaper 45 to a differentiator 46 which differentiates the rise and fall transitions of input pulses to produce pulses twice the original pulses derived from the slits 25. The differentiator 46 is connected to the down-counter 39 and also to the I/O port 14. The differentiator 46 is further connected to an overrun detector 47, which is in connection with the I/O port 14.

Furthermore, a print controller 48 is connected between the I/O port 14 and the printer 4.

In this arrangement, when the label 2 is absent from the label detector 22, or when the flip-flop 41 is reset, the OR gate 38 outputs a high level to load the down-counter 39 with the contents of a feed setup switch 30 specified by the print format selector switch 39*d*. This operation may be considered as presetting, since the down-counter 39 is loaded irrespective of its initial contents when a high level is given by the OR gate 38. In this state, when the flip-flop 41 receives a feed signal from the I/O port 14, it is set, causing the inverter 40 to output a low level signal and, at the same time, supplying the motor 6 with the 100 VAC power voltage through the driver 42. Then, the motor 6 rotates to feed the ribbon 1, and at the same time the rotating slit disk causes the photo-transistor 44 to emit pulses which, in turn, is supplied to the down-counter 39 and the I/O port 14 as the clock signal. The down-counter, however, does not change its contents, because it still receives a high level from the converter 34. The I/O port 14 is supplied with the clock signal from the photo-transistor 44, and this signal or a divided clock is used to produce the print command which is supplied to the printer 4 as a timing signal for printing. This printer 4 is different from one shown in FIG. 1, but, for example, a label printer for merely printing a single line, and it prints characters sequentially from the left end of the label 2 in accordance with the feed signal C as shown in FIG. 25.

While the time elapses in this state, the front edge 21 of the label 2 is detected by the label detector 22, and the output of the converter 34, i.e. the front edge detection signal B, goes low to release the down-counter from loading. From this moment, the down-counter 39 receives pulses from the slit detector 27 to decrement its contents. When the down-counter 39 becomes empty, the flip-flop 41 is reset. Then, the motor 6 stops and the down-counter 39 is loaded again.

After the front edge 21 of the label 2 has been detected, the label is printed while it is fed at a certain pitch, then transportation of the ribbon 1 is halted.

An overrun detector 47 detects an overrun of the ribbon 1 which could occur after the motor 6 has stopped, sending a signal having a certain duration to the CPU 13 following the deactivation of the motor 6 so that any other operation is held during the overrun in order to prevent malfunctioning.

Figure 27:
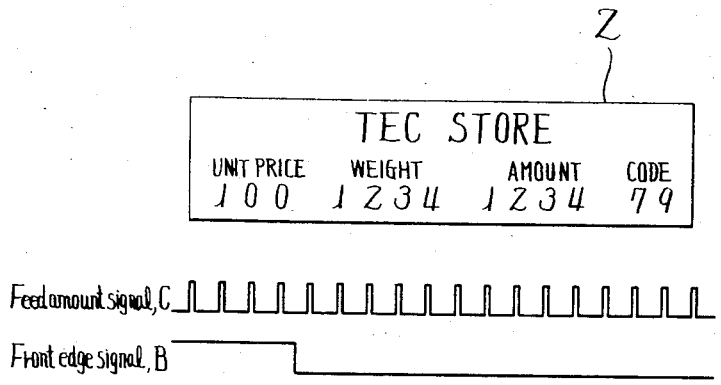
FIG. 27 is a set of illustration showing the relationship between the print form of the label and the signals.
Figure 28:
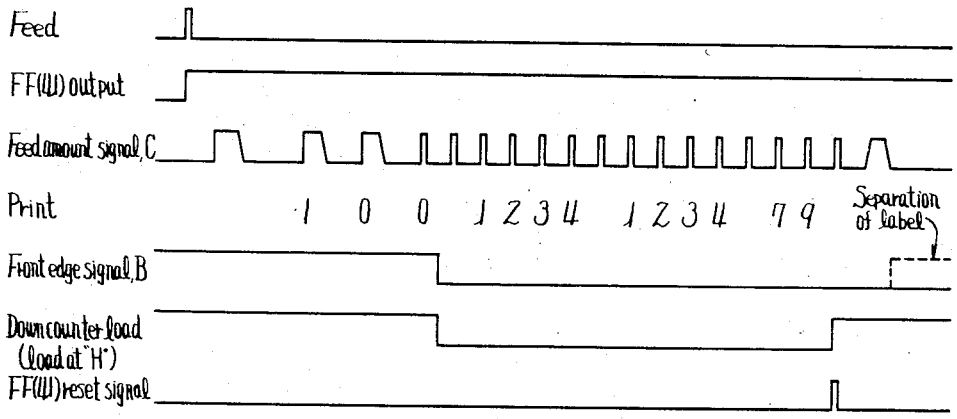
FIG. 28 is a timing chart for the system of FIG. 26.

After the label 2 has been printed as shown in FIG. 27, it is stopped at the predetermined position. This operation is shown on the timing chart of the signals in FIG. 28. As can be seen in the figure, when the FEED signal is issued, the flip-flop 41 is set, causing the motor 6 to start rotating, and the feed amount signal C is generated. Initially, the feed amount signal C varies its period, and gradually a steady period is reached. The feed amount signal C serves as a timing signal for printing irrespective of its period, and a character is printed for each feed amount signal C by the means as will be described shortly. In the earlier stage of the operation when the label 2 has not reached the label detector 22, the label 2 is fed while being printed. When the label detector 22 detects the front edge 21 of the label, the front edge detection signal B goes low, releasing the down-counter 39 from loading. Then, the down-counter 39 is decremented by the feed amount signal C. When the down-counter 39 becomes empty, a reset signal is generated to reset the flip-flop 41 and the motor 6 is stopped.

Figure 29:
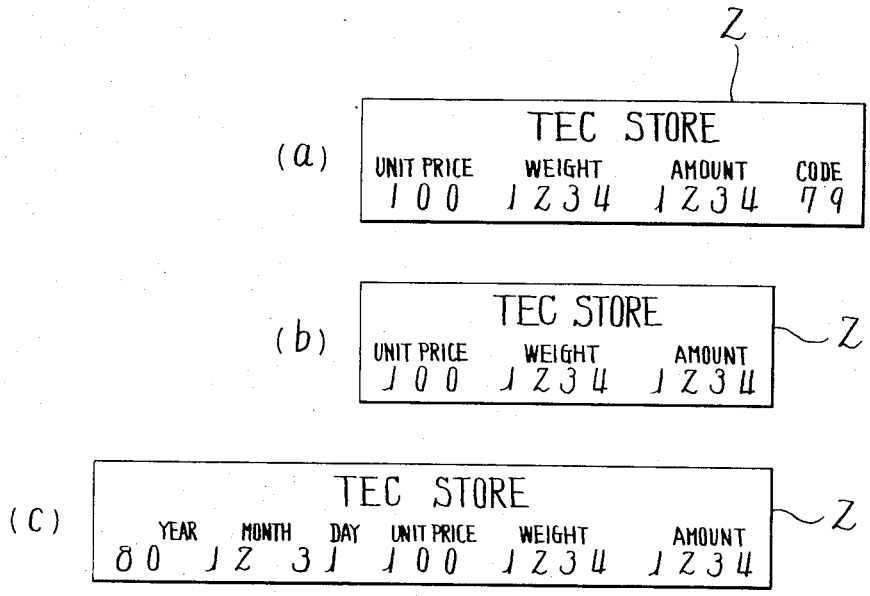
FIGS. 29-a, 29-b and 29-c are illustrations showing various print formats of the label.

It is desirable to provide several kinds of print format for the label 2 to be issued. If, for example, three kinds of print format as shown in FIG. 29 are required, they are preset on the feed setup switches 30*a*, 30*b* and 30*c*. The delivery position of the label 2 must be determined so that a peeled-off label can be picked up by hand.

Thus, the feed amount after detecting the front edge 21 is determined in consideration of the interval of labels on the base ribbon and the number of characters to be printed. For this purpose, the print format selector switch 39*d* is set appropriately according to the desired print format.

Figure 30:
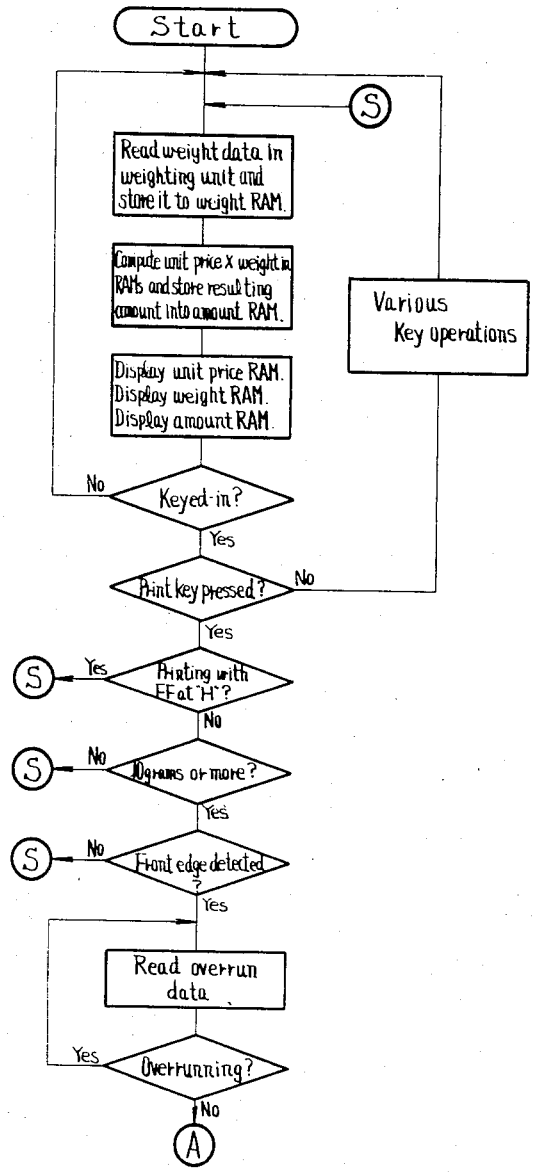
FIGS. 30 and 31 are flowcharts for the system of FIGS. 26.
Figure 31:
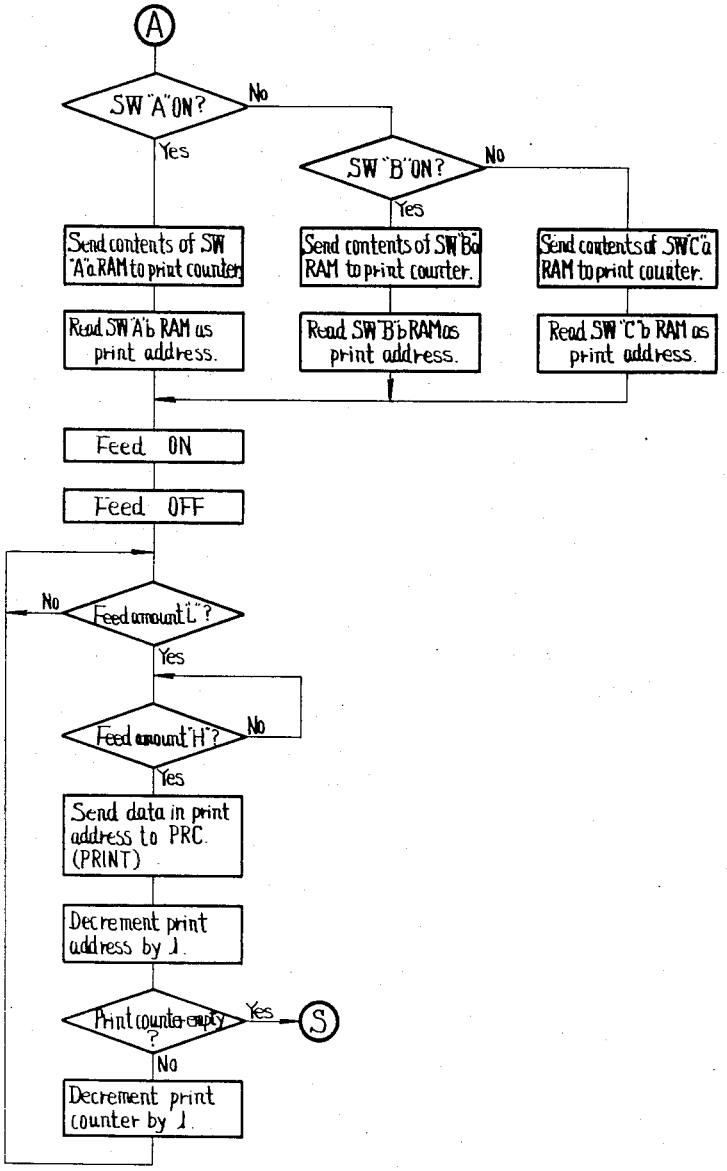

Operation of the system will be described with reference to FIGS. 30 through 32. The RAM is provided with fields for storing data of the unit price, weight, amount, code, date, the contents of the print counter, and print address, and also provided with fields SW"A"a, SW"A"b, SW"B"a, SW"B"b, SW"C"a, and SW"C"b for storing data corresponding to the contents of the feed setup switches 30*a*, 30*b* and 30*c*, respectively. As shown in FIG. 13, when the system starts operating, a weight data from the weighing unit 11 is stored into the weight RAM. The weight data is multiplied with the unit price which has been set in the unit price RAM, and the result is stored in the amount RAM. The contents of the unit price RAM, weight RAM and amount RAM are then displayed on the respective sections of the read out unit (not shown). Setup of the switches such as the MAN/AUTO selector switch is checked. When the switch operation is confirmed, pressing of the PRINT key is checked. After the keying of the PRINT key has been confirmed, the conditions that whether printing goes on, the weight is 10 grams or more, and the label 2 exists on the label detector 22 are checked sequentially. If these conditions are not met, control returns to point S on the flowchart, or if the conditions are met, overrun data is read in. If the label is overrunning, the system waits until the overrun ceases, then proceeds to point A. From point A, control proceeds as shown in FIG. 31. The ON-condition of SW"A" and SW"B" is checked sequentially in order to find which contact out of A, B and C of the print format selector switch 39*d* is made. Assuming that contact A is selected, the contents of field SW"A"a in the RAM are delivered to the print counter, and the contents of field SW"A"b are read as the print address. The blocks of FEED ON and FEED OFF in FIG. 31 signify issue of an FEED signal shown in FIG. 28, by which data specified by the print address is transferred to the print controller 48 at the second rising edge of the feed amount signal C. After a character has been printed, the print address is decremented by one, and the print counter is also decremented by one unless it is empty. Thus, operation for checking a low level feed amount signal C is cycled. In this way, the unit price and other data are printed sequentially, and control returns to point S after the print counter has become empty. This control is performed only for printing, and feeding of the label 2 is controlled as mentioned previously.

Figure 33:
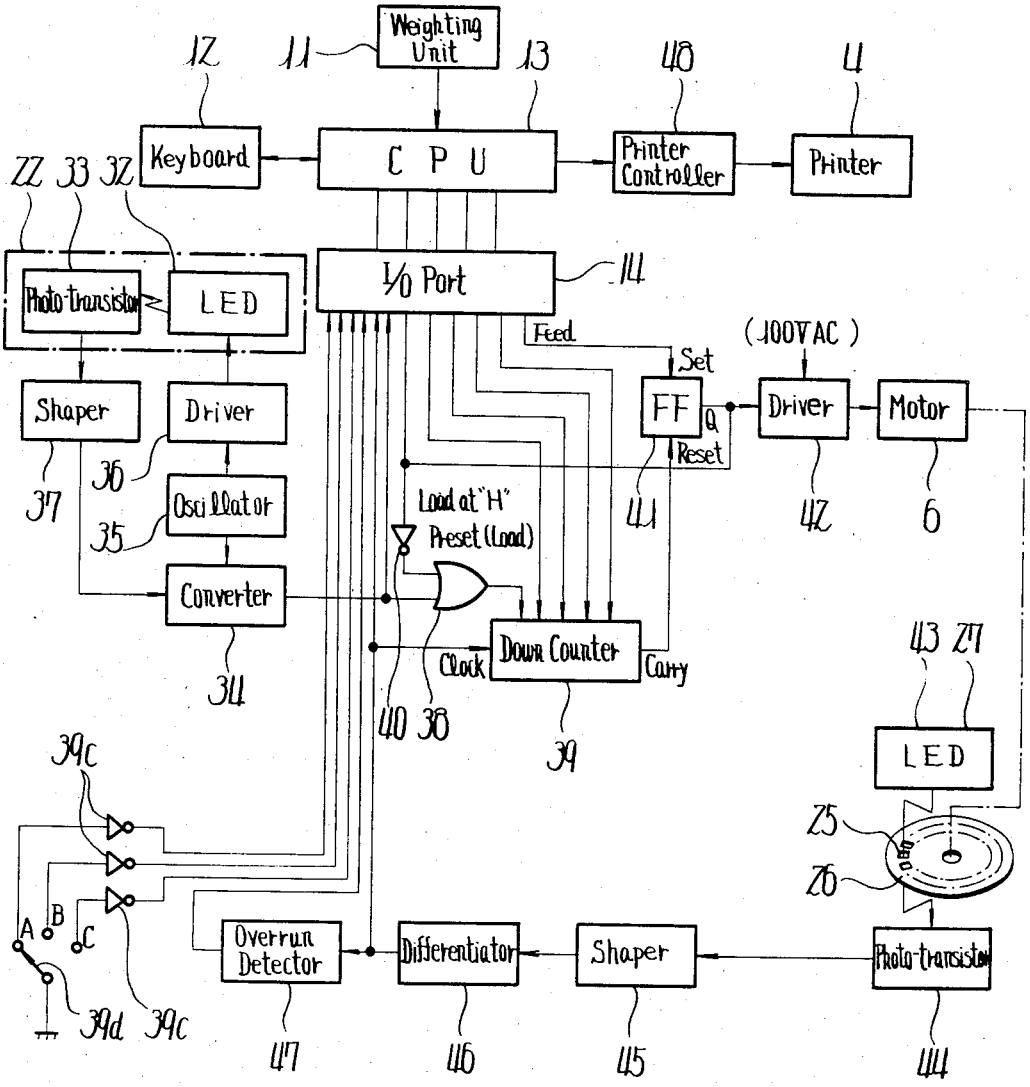
FIG. 33 is a block diagram showing the seventh embodiment of the invention.

The seventh embodiment of the invention will be described with reference to FIGS. 33 through 35. In this embodiment, the amount of feed is controlled by the CPU 13 without use of the feed setup switch 30 as used in the previous embodiments. The down-counter 39 is connected directly to the I/O port 14, and the RAM is arranged to preset by means of a preset button (not shown). Therefore, the RAM is further provided with fields, SW"A"c, SW"B"c and SW"C"c. The print format selector switch 39*d* is connected directly to the I/O port 14.

Figure 34:
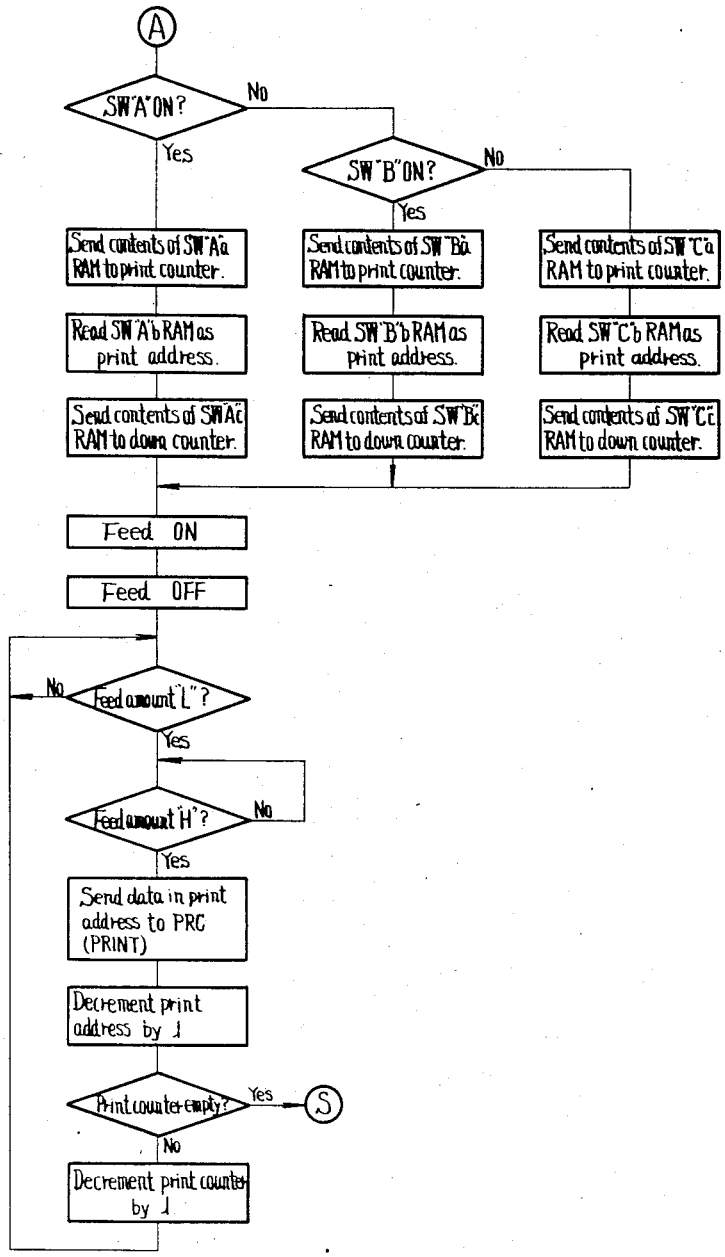
FIG. 34 is a flowchart for the seventh embodiment system.

Operation of this system as shown in FIG. 34 is identical to that shown in FIG. 31, except that the processes for delivering the contents of the SW"A"c, SW"B"c and SW"C"c to the down-counter 39 are added.

What is claimed is:

1. A label feed control system comprising a driver means for driving a feed means which transports a paper base ribbon with labels lightly adhered thereon, a separator means for peeling said label off said base ribbon, a label detector disposed adjacent said separator means for detecting a peeled-off front edge of said label while said label adheres to said base ribbon and after the front edge is peeled off said base ribbon by said separator means, and an incremental feed means for controlling the operation of said driver means such that said base ribbon is fed for a certain amount after said label detector has detected the peeled-off front edge of said label.

2. A label feed control system according to claim 1, wherein said driver means comprises an electric motor which rotates in synchronization with the power frequency, said incremental feed means determining the amount of feed by counting said power frequency.

3. A label feed control system according to claim 1, wherein said driver means comprises a stepping motor which rotates under control of signals supplied from an oscillator, said incremental feed means determining the amount of feed by counting pulses from said oscillator.

4. A label feed control system comprising a driver means for driving a feed means which transports a paper base ribbon with labels lightly adhered thereon, a separator means for peeling said label off said base ribbon, a label detector disposed adjacent said separator means for detecting a peeled off front edge of said label while said label adheres to said base ribbon and after the front edge is peeled off said base ribbon by said separator means, an incremental feed means for controlling the operation of said drive means such that said base ribbon is fed for a certain amount after said label detector has detected the peeled-off front edge of said label, said incremental feed means operating under numerical control, and a feed amount setup means for variably presetting the amount of incremental feed numerically.

5. A label feed control system comprising a driver means for driving a feed means which transports a paper base ribbon with labels lightly adhered thereon, a separator means for peeling said label off said base ribbon, a label detector disposed adjacent said separator means for detecting a peeled-off front edge of said label while said label adheres to said base ribbon and after the front edge is peeled-off said base ribbon by said separator means, and an incremental feed means for controlling the operation of said driver means such that said base ribbon is fed for a certain amount after said label detector has detected the peeled-off front edge of said label, said incremental feed means operating under numerical control, the amount of incremental feed being entered into a RAM within a CPU by use of a display means and a ten-key means so that the amount of feed by said incremental feed means is set by data in said RAM.

6. A label feed control system comprising a feed roller for transporting intermittently a paper base ribbon with labels lightly adhered thereon, a driver means for driving said feed roller, a separator means for peeling said label off said base ribbon while said base ribbon is bent on said separator means, a slit disk operable to rotate in synchronization with said feed roller, a slit detector for detecting slits on said slit disk, a label detector disposed adjacent said separator means for detecting a peeled-off front edge of said label while said label adheres to said base ribbon and after the front edge is peeled-off said base ribbon by said separator means, and an incremental feed means for feeding said base ribbon for a certain amount by counting signals from said slit detector upon reception of a front edge detection signal from said label detector.

7. A label feed control system comprising a feed roller for transporting intermittently a paper base ribbon with labels lightly adhered thereon, a driver means for driving said feed roller, a separator means for peeling said label off said base ribbon while said base ribbon is bent on said separator means, a slit disk operable to rotate in synchronization with said feed roller, a slit detector for detecting slits on said slit disk, a label detector disposed adjacent said separator means for detecting a peeled-off front edge of said label while said label adheres to said base ribbon and after the front edge is peeled-off said base ribbon by said separator means, and an incremental feed means for feeding said base ribbon for a certain amount by counting signals from said slit detector upon reception of a front edge detection signal from said label detector, the position in which said peeled-off label is stopped being set to a position detected by said label detector, said label detector also serving for detecting the presence of said label.

8. A label feed control system comprising a feed roller for transportin intermittently a paper base ribbon with labels lightly adhered thereon, a drive means for driving said feed roller, a separator means for peeling said label off said base ribbon while said base ribbon is bent on said separator means, a slit disk operable to rotate in synchronization with said feed roller, a slit detector for detecting slits on said slit disk, a label detector disposed adjacent said separator means for detecting a peeled-off front edge of said label while said label adheres to said base ribbon and after the front edge is peeled-off said base ribbon by said separator means, and an incremental feed means for feeding said base ribbon for a certain amount by coutning signals from said slit detector upon reception of a front edge detection signal from said label detector, and an overrun detector for detecting the overrun of said base ribbon by receiving said signals from said slit detector.

9. A label feed control system comprising a feed roller for transporting intermittently a paper base ribbon with labels lightly adhered thereon, a drive means for driving said feed roller, a separator means for peeling said label off said base ribbon while said base ribbon is bent on said separator means, a slit disk operable to rotate in synchronization with said feed roller, a slit detector for detecting slits on said slit disk, a label detector disposed adjacent said separator means for detecting a peeled-off front edge of said label while said label adheres to said base ribbon and after the front edge is peeled-off said base ribbon by said separator means, and an incremental feed means for feeding said base ribbon for a certain amount by counting signals from said slit detector upon reception of a front edge detection signal from said label detector, and a further incremental feed means for feeding said base ribbon for an amount corresponding to a predetermined number of signal from said slit detector while said base ribbon travels from its reference position to a position in which the front edge of said label is detected by said label detector.

10. A label feed control system comprising a feed roller for transporting intermittently a paper base ribbon with labels lightly adhered thereon, a drive means for driving said feed roller, a separator means for peeling said label off said base ribbon while said base ribbon is bent on said separator means, a slit disk operable to rotate in synchronization with said feed roller, a slit detector for detecting slits on said slit disk, a label detector disposed adjacent said separator means for detecting a peeled-off front edge of said label while said label adheres to said base ribbon and after the front edge is peeled-off said base ribbon by said separator means, and in incremental feed means for feeding said base ribbon for a certain amount by counting a predetermined number of signals from said feed amount detector upon reception of a front edge detection signal from said label detector.

11. A label feed control system comprising a feed roller for transporting intermittently a paper base ribbon with labels lightly adhered thereon, a drive means for driving said feed roller, a separator means for peeling said label off said base ribbon while said base ribbon is bent on said separator means, a slit disk operable to rotate in synchonization with said feed roller, a slit detector for detecting slits on said slit disk, a label detector disposed adjacent said separator means for detecting a peeled-off front edge of said label while said label adheres to said base ribbon and after the front edge is peeled-off said base ribbon by said separator means, and an incremental feed means for feeding said base ribbon for a certain amount by counting signals from said slit detector upon reception of a front edge detection signal from said label detector, the number of signals counted by said incremental feed means corresponding to a print format selected by said print format selector means.

* * * * *